US006929522B1

(12) United States Patent
Takegami

(10) Patent No.: US 6,929,522 B1
(45) Date of Patent: Aug. 16, 2005

(54) METHOD OF MANUFACTURING ELECTRON SOURCE AND IMAGE DISPLAY APPARATUS

(75) Inventor: Tsuyoshi Takegami, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/467,983

(22) Filed: Dec. 21, 1999

(30) Foreign Application Priority Data

Dec. 22, 1998 (JP) ..... 10-365508
Dec. 17, 1999 (JP) ..... 11-358857

(51) Int. Cl.[7] ..... H01J 9/00; H01J 9/44
(52) U.S. Cl. ..... 445/6; 445/24
(58) Field of Search ..... 445/24, 6, 25, 445/49, 50, 51

(56) References Cited

U.S. PATENT DOCUMENTS 5,066,883 A 11/1991 Yoshioka et al. ..... 313/309

FOREIGN PATENT DOCUMENTS

| | | | | |
|---|---|---|---|---|
| EP | 726591 A1 * | 8/1996 | ..... | H01J/9/02 |
| EP | 729168 A2 * | 8/1996 | ..... | H01J/1/30 |
| JP | 64-31332 | 2/1989 | | |
| JP | 2-257551 | 10/1990 | | |

OTHER PUBLICATIONS

C.A. Mead, "Operation of Tunnel–Emission Devices", Journal of Applied Physics, Apr. 1961, pp. 646–652.

M.I. Elinson et al., "The Emission of Hot Electrons and The Field Emission of Electrons From Tin Oxide", Radio Engineering and Electronic Physics, Jul. 1965, pp. 1290–1296.

H. Araki, "Electroforming and Electron Emission of Carbon Thin Films", Journal of th Vacuum, Society of Japan, 1983, pp. 22–29 (with English Abstract). no month.

G. Dittmer, "Electrical Conduction and Electron Emission of Discontinuous Thin Films" Thin Solid Films, 9, 1972, pp. 317–328. no month.

M. Hartwell, "Strong Electron Emission From Patterned Tin–Indium Oxide Thin Films", IEDM, 1975, pp. 519–521. no month.

C.A. Spindt, "Physical Properties of Thin–Film Emission Cathodes with Molybdenum Cones", J. Applied Physics, vol. 47, No. 12, Dec. 1976, pp. 5248–5263.

J. Dyke et al., "Field Emission", Advances in Electronics and Electron Physics, vol. VIII, 1956, pp. 89–185. no month.

* cited by examiner

*Primary Examiner*—Ashok Patel
*Assistant Examiner*—Mariceli Santiago
(74) *Attorney, Agent, or Firm*—Fitzpatrick, Cella, Harper & Scinto

(57) ABSTRACT

In a method of manufacturing an electron source, a plurality of row wirings, a plurality of column wirings, and a plurality of pairs of conductive films arranged in a matrix by the plurality of row and column wirings, are formed on a substrate, each pair of conductive films being formed through a gap. After then, a row wiring is selected among the plurality of row wirings in the presence of an activation substance source, and a substantially same constant voltage is applied to each of a plurality of pairs of conductive films connected to the selected row wiring, while a predetermined voltage is applied to at least specific pairs of conductive films among a plurality of pairs of conductive films connected to unselected row wirings of the plurality of row wirings.

13 Claims, 31 Drawing Sheets

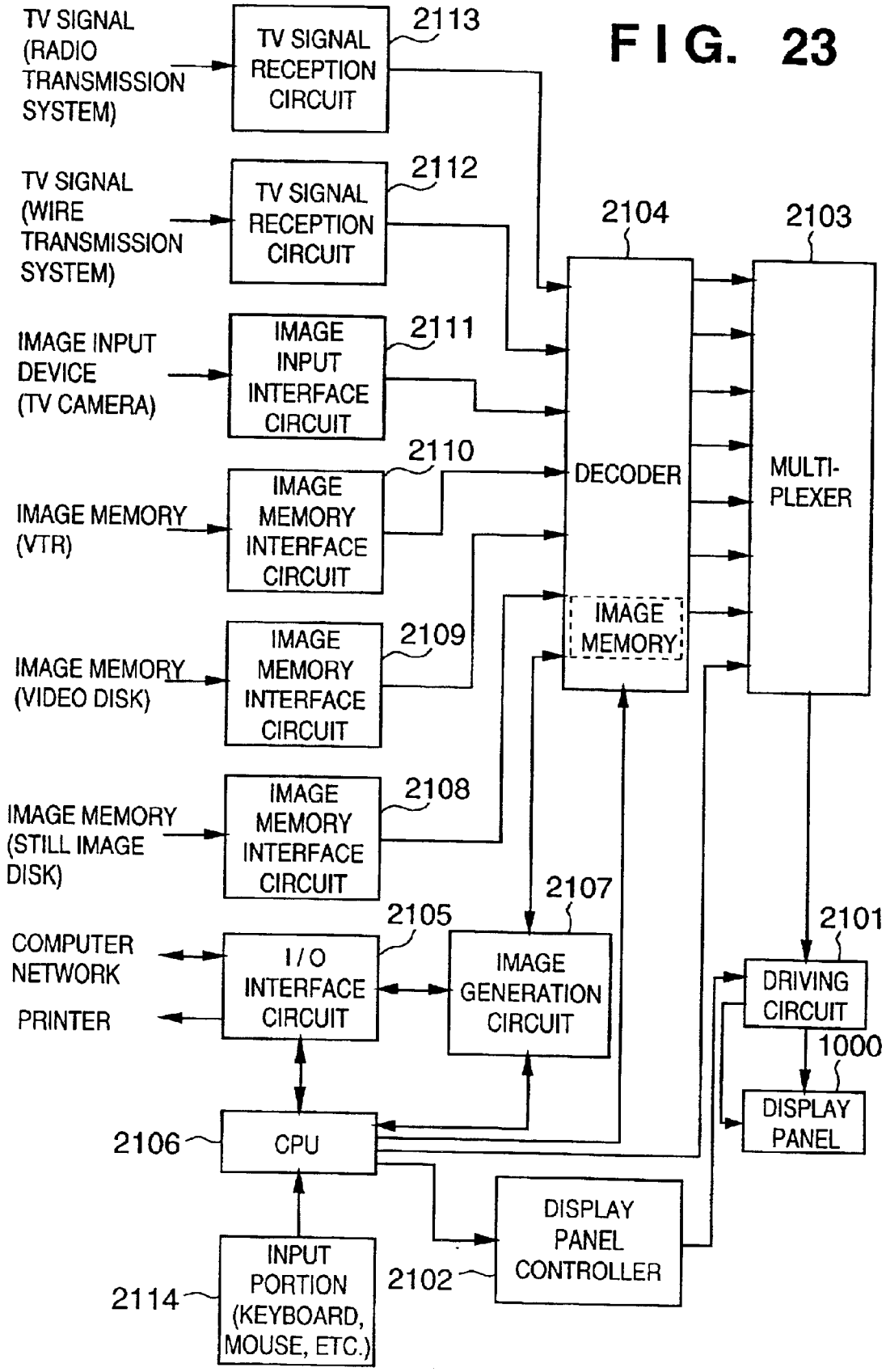
FIG. 23
TV SIGNAL (RADIO TRANSMISSION SYSTEM)
TV SIGNAL RECEPTION CIRCUIT
2113
TV SIGNAL (WIRE TRANSMISSION SYSTEM)
TV SIGNAL RECEPTION CIRCUIT
2112
IMAGE INPUT DEVICE (TV CAMERA)
IMAGE INPUT INTERFACE CIRCUIT
2111
IMAGE MEMORY (VTR)
IMAGE MEMORY INTERFACE CIRCUIT
2110
IMAGE MEMORY (VIDEO DISK)
IMAGE MEMORY INTERFACE CIRCUIT
2109
IMAGE MEMORY (STILL IMAGE DISK)
IMAGE MEMORY INTERFACE CIRCUIT
2108
2104
DECODER
IMAGE MEMORY
2103
MULTI-PLEXER
2107
IMAGE GENERATION CIRCUIT
2105
COMPUTER NETWORK
PRINTER
I/O INTERFACE CIRCUIT
2101
DRIVING CIRCUIT
1000
DISPLAY PANEL
2106
CPU
DISPLAY PANEL CONTROLLER
2102
2114
INPUT PORTION (KEYBOARD, MOUSE, ETC.)

METHOD OF MANUFACTURING ELECTRON SOURCE AND IMAGE DISPLAY APPARATUS

BACKGROUND OF THE INVENTION

1. Field of the Invention

The present invention relates to a method of manufacturing an electron source having an array of a plurality of electron-emitting devices, and manufacturing an image display apparatus using the electron source.

2. Description of the Related Art

Conventionally, two types of devices, namely hot and cold cathode devices, are known as electron-emitting devices. Known examples of the cold cathode devices are surface-conduction type emission devices, field emission type electron-emitting devices(to be referred to as FE type electron-emitting devices hereinafter), and metal/insulator/metal type electron-emitting devices (to be referred to as MIM type electron-emitting devices hereinafter).

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenium cones", J. Appl. Phys., 47, 5248 (1976).

A known example of the MIM type electron-emitting devices is described in C. A. Mead, "Operation of tunnel-emission devices", J. Appl. Phys., 32,646 (1961).

A known example of the surface-conduction type emission devices is described in, e.g., M. I. Elinson, "Radio E-ng. Electron Phys., 10, 1290 (1965) and other examples will be described later.

The surface-conduction type emission device utilizes the phenomenon that electrons are emitted from a small-area thin film formed on a substrate by flowing a current parallel through the film surface. The surface-conduction type emission device includes electron-emitting devices using an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 24 is a plan view showing the device by M. Hartwell et al. described above as a typical example of the device structures of these surface-conduction type emission devices. Referring to FIG. 24, reference numeral 3001 denotes a substrate; and 3004, a conductive thin film made of a metal oxide formed by sputtering. This conductive thin film 3004 has an H-shaped pattern, as shown in FIG. 24. An electron-emitting portion 3005 is formed by performing electrification processing (referred to as forming processing to be described later) with respect to the conductive thin film 3004. An interval L in FIG. 24 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion.

In the above surface-conduction type emission devices by M. Hartwell et al. and the like, typically the electron-emitting portion 3005 is formed by performing electrification processing called forming processing for the conductive thin film 3004 before electron emission. In the forming processing, for example, a constant DC voltage or a DC voltage which increases at a very low rate of, e.g., 1 V/min is applied across the two ends of the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after the forming processing, electrons are emitted near the fissure.

The above surface-conduction type emission devices are advantageous because they have a simple structure and can be easily manufactured. For this reason, many devices can be formed on a wide area. As disclosed in Japanese Patent Laid-Open No. 64-31332 filed by the present applicant, a method of arranging and driving a lot of devices has been studied.

Regarding applications of surface-conduction type emission devices to, e.g., image forming apparatuses such as an image display apparatus and an image recording apparatus, electron sources, and the like have been studied.

As an application to image display apparatuses, in particular, as disclosed in the U.S. Pat. No. 5,066,883 and Japanese Patent Laid-Open No. 2-257551 filed by the present applicant, an image display apparatus using the combination of a surface-conduction type emission device and a fluorescent substance which emits light upon reception of electrons has been studied. This type of image display apparatus using the combination of the surface-conduction type emission device and the fluorescent substance is expected to have more excellent characteristics than other conventional image display apparatuses. For example, in comparison with recent popular liquid crystal display apparatuses, the above display apparatus is superior in that it does not require a backlight because it is of a self-emission type and that it has a wide view angle.

The present inventors have examined surface-conduction type emission devices of various materials, various manufacturing methods, and various structures, in addition to the above-mentioned conventional surface-conduction type emission device. Further, the present inventors have made extensive studies on a multi electron source having a large number of surface-conduction type emission devices, and an image display apparatus using this multi electron source.

The present inventors have examined a multi electron source using an electrical wiring method shown in, e.g., FIG. 25. That is, a large number of surface-conduction type emission devices are two-dimensionally arranged in a matrix to obtain a multi electron source, as shown in FIG. 25.

Referring to FIG. 25, numeral 4001 denotes a surface-conduction type emission device; 4002, a row wiring; and 4003, a column wiring. The row and column wirings 4002 and 4003 actually have finite electrical resistances, which are represented as wiring resistances 4004 and 4005 in FIG. 25. This wiring method is called a simple matrix wiring method. For the illustrative convenience, the multi electron source is illustrated in a 6×6 matrix, but the size of the matrix is not limited to this. For example, in a multi electron source for an image display apparatus, a number of devices enough to perform a desired image display are arranged and wired.

In a multi electron source in which surface-conduction type emission devices are arranged in a simple matrix, appropriate electrical signals are applied to the row and column wirings 4002 and 4003 to output a desired electron beam. For example, to drive the surface-conduction type emission devices on an arbitrary row in the matrix, a selection voltage Vs is applied to the column wiring 4002 on the row to be selected, and at the same time, a non-selection voltage Vns is applied to the row wirings 4002 on unselected rows. In synchronism with this, a driving voltage Ve for outputting electrons is applied to the column wirings 4003. According to this method, when voltage drops across the wiring resistances 4004 and 4005 are neglected, a voltage (Ve−Vs) is applied to the surface-conduction type emission device on the selected row, and a voltage (Ve−Vns) is applied to the surface-conduction type emission devices on the unselected rows. When the voltages Ve, Vs, and Vns are set to appropriate levels, electrons having a desired intensity must be output from only the surface-conduction type emission device on the selected row. When different driving voltages Ve are applied to the respective column wirings, electrons having different intensities must be output from respective devices on the selected row. Since the surface-conduction type emission device has a high response speed, a time for outputting an electron beam can be changed by changing a time for applying the driving voltage Ve.

A multi electron source obtained by arranging surface-conduction type emission devices in a simple matrix has a variety of applications. For example, when a voltage signal corresponding to image information is appropriately applied, the multi electron source can be applied as an electron source for an image display apparatus.

The present inventors have made extensive studies for improving the characteristics of the surface-conduction type emission device to find that activation processing is effectively performed during the manufacture.

As described above, the electron-emitting portion of the surface-conduction type emission device is formed by processing (forming processing) of flowing a current through a conductive thin film to partially destroy or deform this thin film, thereby forming a fissure. If activation processing is performed subsequently, electron-emitting characteristics can be greatly improved.

In activation processing, the electron-emitting portion formed by the forming processing is electrified under appropriate conditions to deposit carbon or a carbon compound around the electron-emitting portion. Graphite monocrystalline, graphite polycrystalline, amorphous carbon, or mixture thereof is deposited to a thickness of 500 Å or less around the electron-emitting portion by periodically applying a voltage pulse in a vacuum atmosphere of $10^{-5}$ Torr. These conditions are merely an example and properly changed in accordance with the material and shape of the surface-conduction type emission device. This processing can increase the emission current at the same application voltage typically 100 times or greater the emission current immediately after forming processing. Note that the partial pressure of the organic substance in the vacuum atmosphere is desirably reduced after activation processing. For this reason, activation processing is desirably performed for each device in manufacturing a multi electron source formed by arranging a large number of surface-conduction type emission devices in a simple matrix.

The additional activation processing stabilizes the electron-emitting characteristics of surface-conduction type emission devices. However, the activation processing applied to multi surface-conduction type emission devices arranged in a simple matrix poses the following problems.

For example, surface-conduction type emission devices arranged in an m×n simple matrix are activated by applying a voltage every predetermined time in the order from the first to mth row wirings. An equivalent circuit in activating the electron-emitting devices arranged in a simple matrix is shown in FIG. 26. FIG. 26 shows the state in which an activation voltage waveform is applied to devices connected to the second row wiring.

FIG. 27 is a waveform chart showing the waveform of an application voltage signal in this activation processing. A voltage waveform having a pulse width T1, period T2, and voltage value Vf0 is applied. The activation time on each row wiring is determined from the activation characteristics of each device as shown in FIG. 28 or the like. Problems occur when devices arranged in a large matrix are activated in units of rows.

More specifically, a larger matrix size increases the influence of a voltage drop caused by the wiring resistance. Some devices cannot receive a sufficient voltage, which varies the electron-emitting characteristics of respective devices.

To give uniform electron-emitting characteristics to respective devices, a uniform voltage must be applied to the devices. However, a larger matrix size causes a larger voltage drop under the influence of the wiring resistance of a row wiring, so no predetermined voltage can be applied. In particular, a desired voltage cannot be applied to devices at almost the center of the row wiring. These devices cannot be satisfactorily activated, thus varying the characteristics of devices arranged in a matrix.

FIGS. 29A and 29B are graphs each schematically showing a voltage drop in matrix wiring. FIG. 29A schematically shows a voltage applied to each device when devices on the second row are activated at the voltage value Vf0 in an m×n simple matrix shown in FIG. 26. Reference symbol F(2,1) denotes a device on the second row and first column; F(2,2), a device on the second row and second column; and F(2,3), a device on the second row and third column. The abscissas in FIG. 29A represents the column number (pixel number). In FIG. 29A, since a voltage is applied from the two sides of the row wiring, as shown in FIG. 26, the voltage drop is the largest on the kth column at almost the center, and the voltage value applied to the device F(2,k) is Vfk (<Vf0). That is, this device receives only a voltage value smaller than the voltage Vf0 to be applied by Vfdf (=Vf0−Vfk).

SUMMARY OF THE INVENTION

The present invention has been made in consideration of the conventional situation, and has as its object to provide a method of manufacturing an electron source having a plurality of electron-emitting devices with electron-emitting characteristics uniform with each other, and manufacturing an image display apparatus using the electron source.

It is another object of the present invention to provide a method of manufacturing an image display apparatus almost free from any luminance variations.

It is still another object of the present invention to reduce a reactive current in the electrification step in manufacturing an electron source having a plurality of electron-emitting devices and an image display apparatus using the electron source.

It is still another object of the present invention to reduce the power source capacity of an apparatus used in the electrification step in manufacturing an electron source having a plurality of electron-emitting devices and an image display apparatus using the electron source.

It is still another object of the present invention to provide a method of manufacturing an electron source which prevents deterioration of electron-emitting devices in manufacture and driving, and manufacturing an image display apparatus using the electron source.

More specifically, according to the present invention, there is provided a method of manufacturing an electron source, comprising: the step of forming, on a substrate, a plurality of row wirings, a plurality of column wirings, and a plurality of pairs of conductive films arranged in a matrix by the pluralities of row and column wirings, each pair of conductive films being formed through a gap; the first voltage application step of selecting a row wiring among the plurality of row wirings in the presence of an activation substance source, and applying a substantially same constant voltage to each of a plurality of pairs of conductive films connected to the selected row wiring; and the second voltage application step of applying a predetermined voltage to at least specific pairs of conductive films among a plurality of pairs of conductive films connected to unselected row wirings.

According to the present invention, there is provided a method of manufacturing an electron source, comprising: the step of forming, on a substrate, a plurality of row wirings, a plurality of column wirings, and a plurality of pairs of conductive films arranged in a matrix by the pluralities of row and column wirings, each pair of conductive films being formed through a gap; the first voltage application step of selecting a row wiring among the plurality of row wirings in the presence of an activation substance source, and applying, to the plurality of column wirings, a voltage set to compensate for influence of a voltage drop caused by a resistance of the selected row wiring; and the second voltage application step of applying a predetermined voltage to at least specific pairs of conductive films among a plurality of conductive films connected to unselected row wirings.

According to the present invention, there is provided a method of manufacturing an electron source, comprising: the step of forming, on a substrate, a plurality of row wirings, a plurality of column wirings, and a plurality of conductive films each having an electron-emitting portion that are arranged in a matrix by the pluralities of row and column wirings; the first voltage application step of selecting a row wiring among the plurality of row wirings in the presence of an activation substance source, and applying a substantially same constant voltage to each of a plurality of pairs of conductive films connected to the selected row wiring; and the second voltage application step of applying a predetermined voltage to at least specific pairs of conductive films among a plurality of pairs of conductive films connected to unselected row wirings.

According to the present invention, there is provided a method of manufacturing an electron source, comprising: the step of forming, on a substrate, a plurality of row wirings, a plurality of column wirings, and a plurality of conductive films each having an electron-emitting portion that are arranged in a matrix by the pluralities of row and column wirings; the first voltage application step of selecting a row wiring among the plurality of row wirings in the presence of an activation substance source, and applying, to the plurality of column wirings, a voltage set to compensate for influence of a voltage drop caused by a resistance of the selected row wiring; and the second voltage application step of applying a predetermined voltage to at least specific pairs of conductive films among a plurality of pairs of conductive films connected to unselected row wirings.

According to the present invention, there is provided a method of manufacturing an image display apparatus having an electron source having, on a substrate, a plurality of row wirings, a plurality of column wirings, and a plurality of electron-emitting devices arranged in a matrix by the pluralities of row and column wirings, and a fluorescent film irradiated with electrons from the electron source, wherein the electron source is manufactured by any one of the above-described methods.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 23 is a block diagram showing an arrangement of a multi-functional display apparatus using the display panel according to the embodiment;

DETAILED DESCRIPTION OF THE PREFERRED EMBODIMENTS

Figure 1:
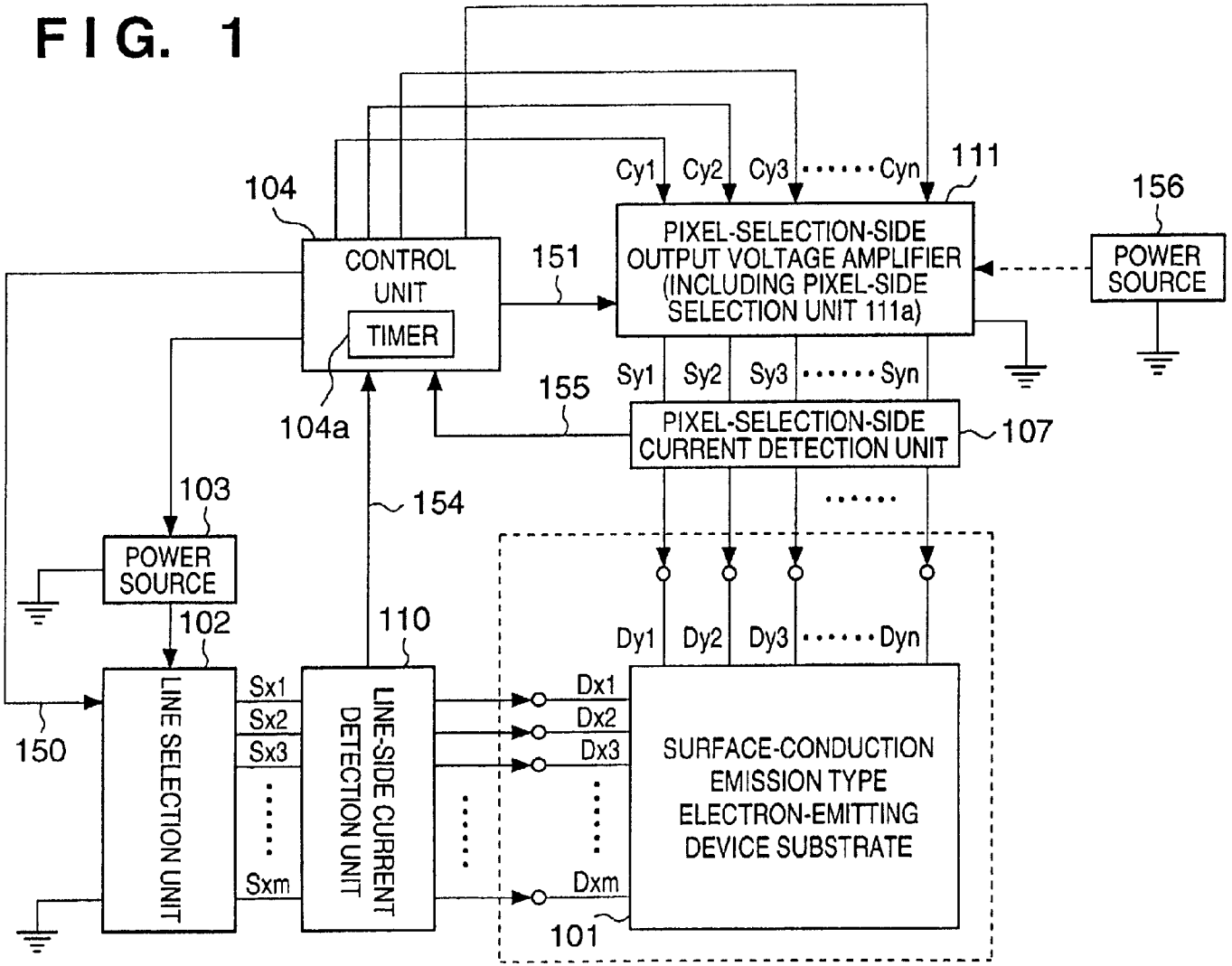
FIG. 1 is a block diagram showing an arrangement of an activation apparatus according to an embodiment.

The present invention will be described in detail below.

The present invention is made in consideration of the prior arts on the basis of the following findings.

The influence of a voltage drop caused by the wiring resistance in the above-described activation processing can be eliminated by changing a voltage applied by an electrode on the column wiring side. This is shown in FIG. 29B. FIG. 29B shows an example of compensating for a voltage drop by the voltage applied by the electrode on the column wiring side. FIG. 30 is a circuit diagram showing a case wherein the voltage for compensating for the influence of a voltage drop is applied by the electrode on the column wiring side. FIG. 30 shows the state in which only devices on the second row are activated among devices arranged in an m×n simple matrix.

According to the above method, however, the compensation voltage is kept applied to devices on unselected lines in vacuum (to be referred to as an activation atmosphere hereinafter) where an activation substance source such as an organic substance exists. These devices decrease in resistance and flow a reactive current.

This reactive current will be explained in detail with reference to FIG. 30. In FIG. 30, a pulse voltage having a peak value Vf is applied to the second row wiring, while voltages Vfd1, Vfd2, Vfd3, . . . , Vfdn are respectively applied to the first, second, third, . . . , nth column wirings. This makes voltage values applied to respective devices on the second row to be almost Vf. The remaining row wirings are set to 0 V, i.e., grounded. The activation voltage Vf is applied to the devices F(2,1), F(2,2), F(2.3), . . . , F(2,n). Meanwhile, the voltages Vfd1, Vfd2, Vfd3, . . . , Vfdn are kept applied to devices on the first, second, third, . . . , nth column wirings, respectively. Devices to which a voltage is applied other than devices connected to a selected row wiring will be defined as half selected devices. When voltage compensation is done by applying a voltage from column wirings, the voltage is kept applied to devices other than selected ones. A decrease in resistance of a device caused by keeping applying voltages to devices other than selected ones will be explained.

The typical I-V characteristic of the device in the activation atmosphere, i.e., the relationship of a current If and voltage Vf applied to the device will be explained. The typical I-V characteristic of a surface-conduction type emission device, i.e., the relationship of the current (If) flowing through the device and the voltage Vf applied to the device will be described with reference to FIG. 31.

When the surface-conduction type emission device exists in the atmosphere containing an organic substance with a proper partial pressure, the current (If) flowing through the device at the voltage (Vf) applied to the device is not necessarily uniquely determined. The characteristics are roughly classified into two types. In the first characteristic, the current (If) flowing through the device temporarily increases with an increase in application voltage (Vf) from 0 V, then decreases, and keeps a constant level or increases slightly. In the second characteristic, the current (If) flowing through the device always increases with an increase in application voltage (Vf) from 0 V.

Figure 31:
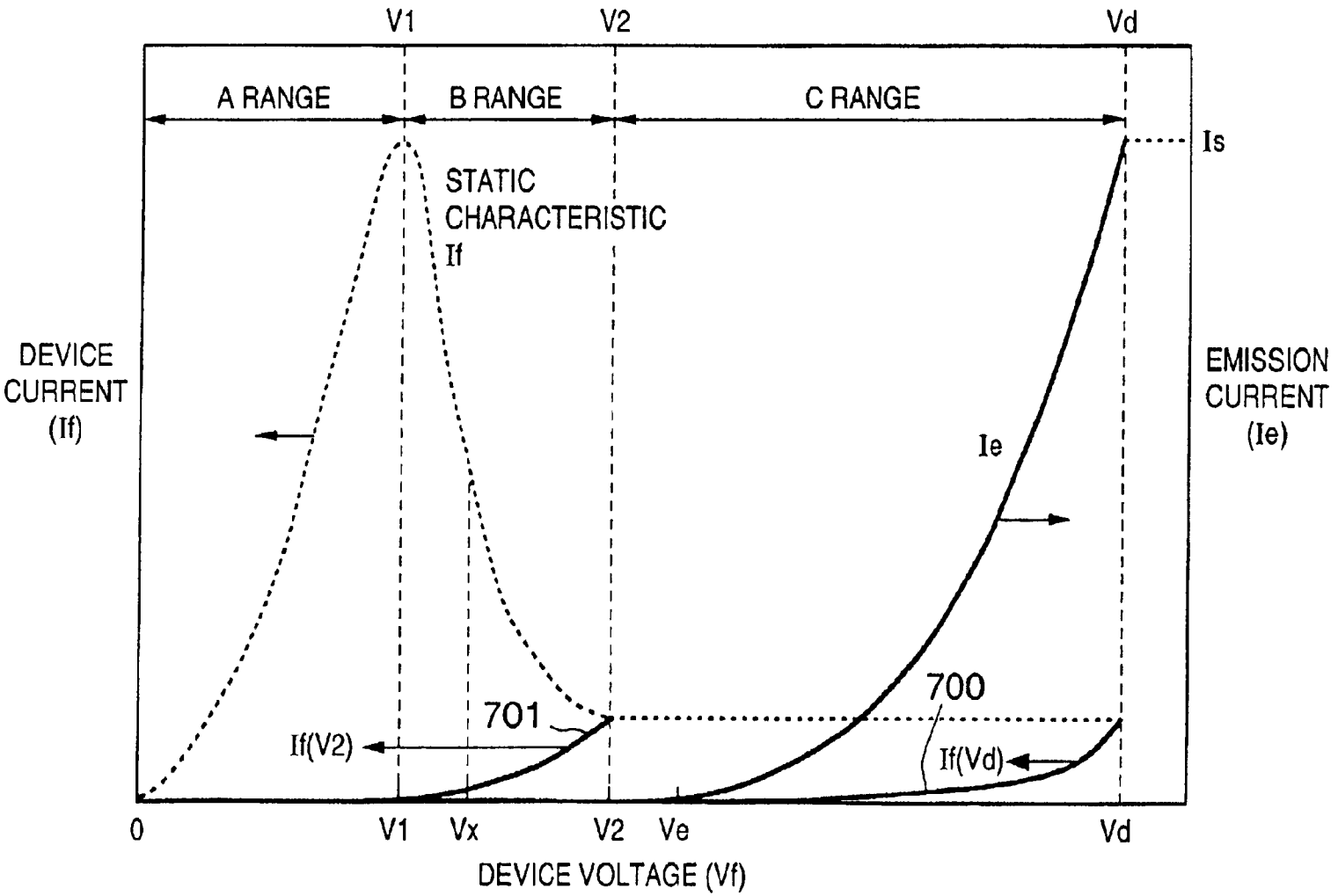
FIG. 31 is a graph for explaining the static characteristic of the surface-conduction type emission device used in the embodiment.

For descriptive convenience, the first and second characteristics will be called static and dynamic characteristics, respectively. In FIG. 31, the broken line represents a static characteristic obtained at a voltage sweep speed of about 1 V/min or less. In a range (range A) at Vf=0 to V1, the device current (If) flowing through the device monotonically increases with an increase in device voltage (Vf), and maximizes at V1. In a range (range B) at Vf=V1 to V2, the current (If) flowing through the device exhibits a so-called voltage controlled negative resistance characteristic (to be referred to as VCNR characteristic) in which the current decreases with an increase in device voltage (Vf). In a range (range C) at a device voltage Vf=V2 to Vd, the current (If) flowing through the device hardly changes with an increase in voltage (Vf). Note that the voltage value V1 represents a device voltage value when the device current If is maximum, and V2 is the Vf axis intercept of the maximum slope tangent out of the decrease curve tangent of the device current If. To the contrary, Ve increases as an electron-emitting threshold along with an increase in emission current (Ie) from the device.

A solid line 700 in FIG. 31 represents a dynamic characteristic obtained at a voltage sweep speed of about 10 V/sec or more. When the current is swept at a maximum device voltage Vd (see the If(Vd) curve), the current (If) flowing through the device at almost the device voltage Ve increases gradually, and attains at the device voltage Vd a device current value which substantially coincides with the device current If exhibiting the static characteristic. A solid line 701 represents a dynamic characteristic (see the If(V2) curve) obtained when the current is swept at a maximum device voltage V2. The device current If gradually increases in the ranges A and B, and substantially coincides with the static characteristic If at the device voltage V2. If the maximum voltage is swept at the maximum voltage of the range A, the characteristic substantially coincides with a dotted If curve exhibiting a static characteristic. The static and dynamic characteristics concerning the I-V characteristic change depending on the device material, device form, and the like. In general, however, a surface-conduction type emission device having high electron-emitting characteristics can be considered to have the above two characteristics.

As described above, simple matrix driving for activating individual devices applies a voltage to devices other than selected ones. As being apparent from FIG. 31, the voltage applied to devices other than selected ones flows a large reactive current. Owing to this reactive current, the activation apparatus must have a large size, and the display panel may generate heat to deteriorate devices much more. Further, a substrate of a given material may be destructed by thermal stress.

The present invention has been made based on the above-described findings.

Note that an electron source made by the manufacturing method of the present invention is formed by wiring a plurality of electron-emitting devices in a matrix by pluralities of row and column wirings. The electron-emitting device of the electron source has a conductive film with an electron-emitting portion. As a preferable structure of the electron-emitting device, a pair of conductive films are formed through a gap, and at least one of the pair of conductive films is covered with an activation substance. As a more preferable structure of the electron-emitting device, a pair of conductive films is formed through a first gap, and an activation substance film having a second gap narrower than the first gap is formed in the first gap and on at least one of the pair of conductive films. An example of the electron-emitting device having this preferable structure is a surface-conduction type emission device having a structure (to be described later). The activation substance is deposited on the conductive film, or on the conductive film and in the first gap. The activation substance increases particularly the emission current amount and activates the device. The activation substance is preferably a film mainly containing carbon.

Preferred embodiments of the present invention will be described in detail below with reference to the accompanying drawings.

First Embodiment

In the first embodiment, surface-conduction type emission devices are arranged in a matrix. The low-resistance phenomenon of unselected devices that occurs in activating devices while compensating for a voltage drop caused by the wiring resistance is detected on the whole matrix. When the low-resistance phenomenon of devices is observed, a resistance increase pulse is applied to all devices to activate them.

FIG. 1 is a block diagram showing an example of an activation apparatus for surface-conduction type emission devices according to the first embodiment.

In FIG. 1, reference numeral 101 denotes a multi surface-conduction type emission device (electron source)substrate (on the substrate 101 of the first embodiment, a plurality of surface-conduction type emission devices are arranged in a matrix and have already undergone forming processing). The substrate 101 is connected to an evacuation device (not shown). A vessel storing this substrate 101 is evacuated to about $10^{-2}$ to $10^{-5}$ Torr. Reference numeral 102 denotes a line selection unit for selecting a row wiring to be activated in accordance with an instruction from a control unit 104, and applying a voltage from a power source 103 to the selected row wiring; 110, a line-side current detection unit for detecting a current value flowing through each row wiring of the substrate 101; and 107, a pixel-selection-side current detection unit for detecting a current value flowing through each column wiring of the substrate 101. The control unit 104 receives the current value detected by the current detection unit 107, determines an activation voltage value, and sets the voltage value in the power source 103 and a pixel-selection-side output voltage amplifier 111. At the same time, the control unit 104 controls the line selection unit 102 and a pixel-side selection unit 111*a* included in the output voltage amplifier 111, thereby controlling selection of the row and column wirings of the substrate 101. Reference symbols Dx1 to Dxm denote row wiring terminals of the electron source substrate 101; and Dy1 to Dyn, column wiring terminals of the electron source substrate 101. A timer 104*a* of the control unit 104 counts a high-resistance holding time Thr (to be described later). A power source 156 is used to apply a resistance increase pulse to a column wiring in the second embodiment (to be described later), and can be omitted in the arrangement of the first embodiment.

Figure 2:
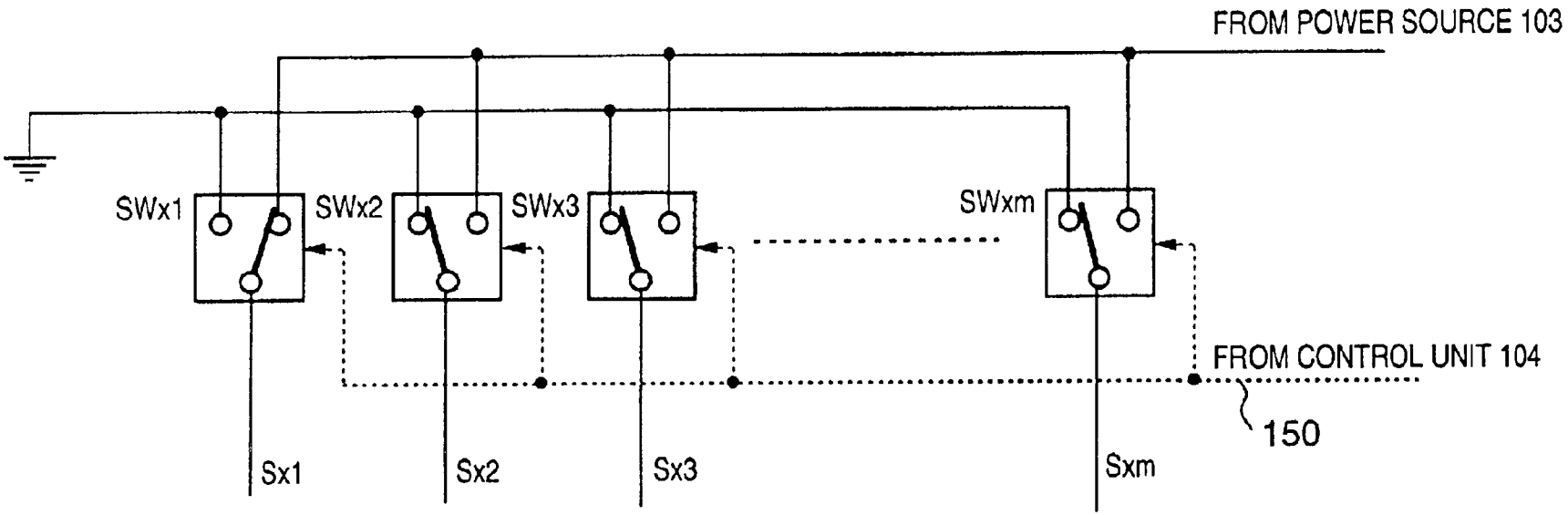
FIG. 2 is a block diagram showing an arrangement of a line selection unit according to the embodiment.

The operation of the line selection unit 102 will be described with reference to FIG. 2. FIG. 2 is a circuit diagram showing the circuit arrangement of the line selection unit 102.

The line selection unit 102 comprises switches such as relays and analog switches. When m×n surface-conduction type emission devices are arranged in a matrix on the electron source substrate 101, m switches SWx1 to SWxm are arranged parallel. The output of each switch is connected to a corresponding one of the row wiring terminals Dx1 to Dxm of the electron source substrate 101. These switches are controlled by a control signal 150 from the control unit 104, and operate to apply a voltage waveform from the power source 103 to a row wiring to be activated. In FIG. 2, the first row (Sx1) is selected and a voltage is applied to only the row wiring terminal Dx1, whereas the remaining lines (unselected row wirings) are grounded.

Figure 3:
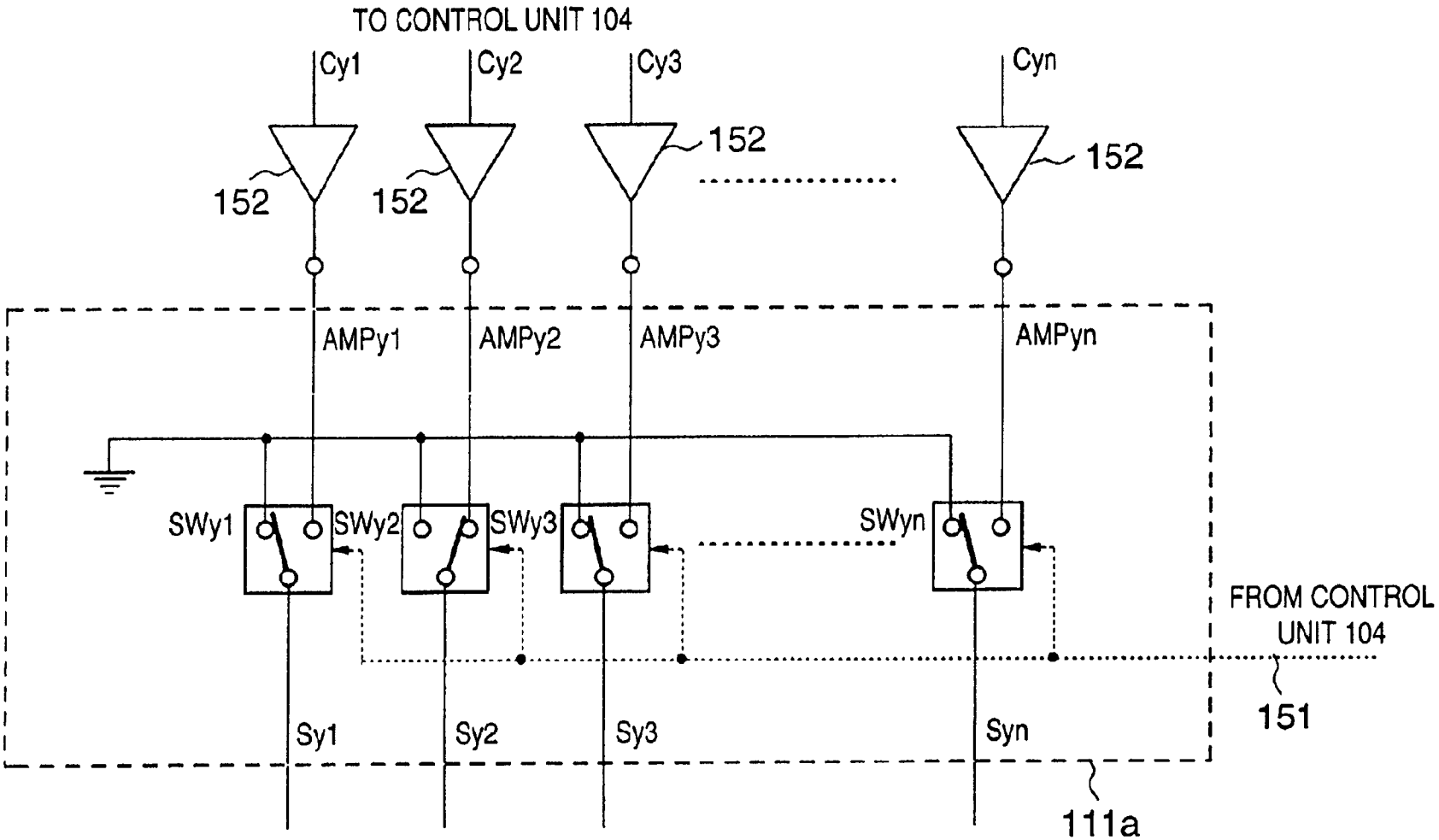
FIG. 3 is a block diagram showing an arrangement of a pixel-selection-side output voltage amplifier according to the embodiment.

FIG. 3 is a circuit diagram showing the circuit arrangement of the pixel-selection-side output voltage amplifier 111.

This voltage amplifier 111 is divided into the pixel-side selection unit 111*a* and output voltage block. Similar to the line selection unit 102, the pixel-side selection unit 111*a* is also constituted by relays, analog switches, and the like, and comprises n switches SWy1 to SWyn. The outputs of the pixel-side selection unit 111*a* are respectively connected to the column wiring terminals Dy1 to Dyn of the electron source substrate 101 via the current detection unit 107. These switches SWy1 to SWyn are controlled by a control signal 151 from the control unit 104, and operate to apply a voltage from the pixel-selection-side output voltage amplifier 111 to a line to be activated. In FIG. 3, the second column wiring (Sy2) is selected, and the remaining column wirings are grounded.

The pixel-selection-side output voltage amplifier 111 has output voltage amplifiers. When m×n surface-conduction type emission devices are arranged in a matrix on the substrate 101, n output amplifiers 152 are arranged. Outputs AMPy1 to AMPyn from the output amplifiers 152 are respectively input to the column wiring terminals Dy1 to Dyn of the electron source substrate 101 via the pixel-side selection unit 111*a* and current detection unit 107. A voltage application pattern applied to these column wirings is set by the control unit 104 on the basis of a line-side current detection value detected by the current detection unit 110 and a detection value detected by the pixel-selection-side current detection unit 107. This pattern is input to the pixel-selection-side output voltage amplifier 111 via control signal terminals Cy1 to Cyn.

Figure 4A:
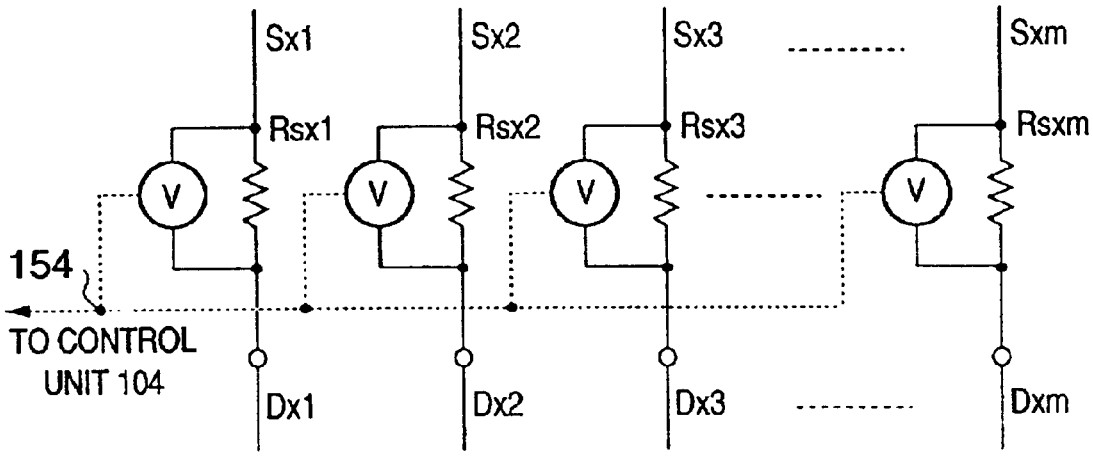
FIGS. 4A and 4B are block diagrams showing arrangements of a line current detection unit and pixel selection current detection unit according to the embodiment, respectively.
Figure 4B:
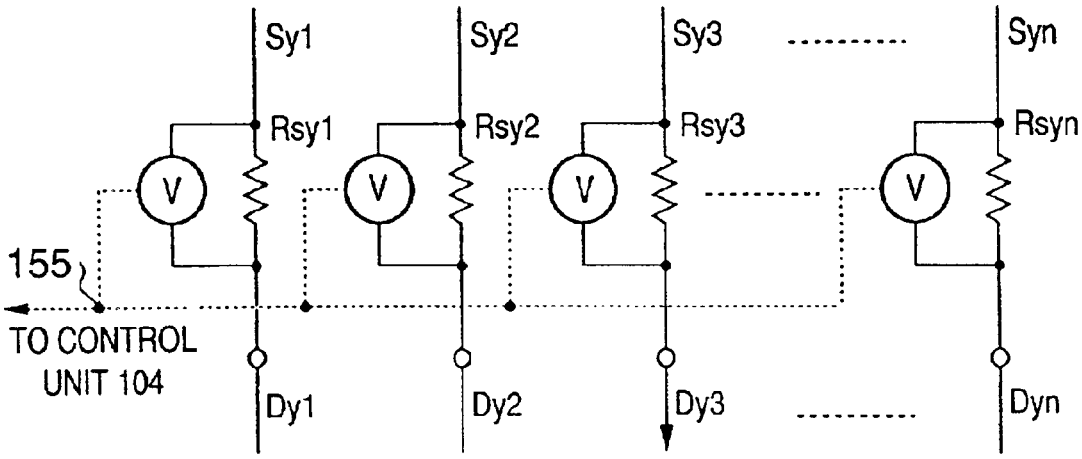

FIGS. 4A and 4B are block diagrams showing the arrangements of the line-side current detection unit 110 and pixel-selection-side current detection unit 107 according to the first embodiment, respectively.

FIG. 4A is a circuit diagram showing the arrangement of the line-side current detection unit 110. A voltage output from the line selection unit 102 is input to the current detection unit 110 via wirings Sx1 to Sxm. The current detection unit 110 comprises current detection resistors Rsx1 to Rsxm, and voltmeters (V) each for measuring a voltage value generated across a corresponding resistor. The control unit 104 receives, from the respective voltmeters, voltage values generated at the current detection resistors Rsx1 to Rsxm corresponding to respective row wirings, and divides each voltage value by the resistance value of a corresponding resistor to obtain a current value flowing through a corresponding row wiring.

FIG. 4B is a circuit diagram showing the arrangement of the pixel-selection-side current detection unit 107.

A voltage signal output from the output voltage amplifier 111 is input to the current detection unit 107 via wirings Sy1 to Syn. The current detection unit 107 comprises detection resistors Rsy1 to Rsyn, and voltmeters each for measuring a voltage value generated across a corresponding resistor. The control unit 104 receives, from the respective voltmeters, voltage values generated at the current detection resistors Rsy1 to Rsyn corresponding to respective column wirings, and divides each voltage value by the resistance value of a corresponding resistor to obtain a current value flowing through a corresponding column wiring.

In the example shown in FIGS. 2 and 3, the device F(1,2) on the first row and second column is selected, and the remaining row and column wirings are grounded. Thus, no current flows through the devices except for the device on the first row and second column. Therefore, voltages are generated across the resistor Rsx1 on the first row in FIG. 4A and the resistor Rsy2 on the second column in FIG. 4B. If the voltage value is V2, a current I1 flowing through the first row wiring can be calculated by $$I1=V2/Rsx1$$

A current I1 flowing through the second column wiring can be calculated by $$I1=V2/Rsy2$$

Note that the resistance values of the resistors Rsx1 to Rsxm and resistors Rsy1 to Rsyn are set low enough not to influence an application voltage to the electron source substrate 101 by a voltage drop caused by the flowing current If. Note that it is possible to convert voltage values measured by the voltmeters into digital values by A/D converters and output the digital values to the control unit 104.

In this way, a current value flowing through each device can be monitored from both the row wiring side and pixel selection (column wiring) side in units of surface-conduction type emission devices.

If all column wirings are grounded in the pixel-side selection unit 111*a*, current values flowing through these wirings can be measured in units of row wirings. Further, if all row wirings are grounded in the line-side selection unit 102, current values flowing through these column wirings can be measured in units of column wirings.

A method of determining a compensation voltage to be output from the control unit 104 to the pixel selection side will be described.

Figure 5:
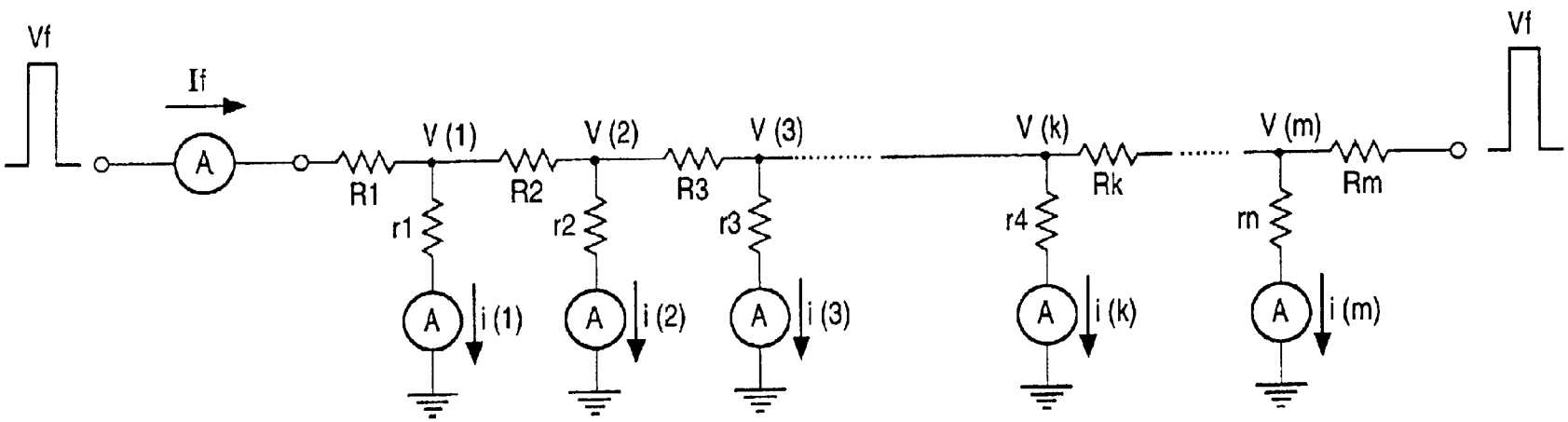
FIG. 5 is a circuit diagram for explaining a voltage drop in electron-emitting devices connected to one row wiring.

FIG. 5 is a circuit diagram showing the case of activating devices on the ith row among m×n surface-conduction type emission devices.

Let Vf be a voltage value applied to the ith row wiring. R1, R2, R3, . . . , Rn be wiring resistances, and r1, r2, r3, . . . , rn be the resistances of respective surface-conduction type emission devices. Assume that all the remaining row wirings are grounded.

Letting R_line_i be the wiring resistance of the ith row (one line).

$$R_line_i=\Sigma Rj\ (j=1 \text{ to } n) \tag{1}$$

Letting If be a current flowing through the ith row, and if(j) be a current flowing through devices on the jth column, a voltage V(1) applied to devices on the first column is given by $$V(1)=Vf-R1\times If$$

This reveals that a voltage applied to devices on the first column becomes lower than the application voltage Vf by R1=If(V) under the influence of the wiring resistance. Similarly, voltages V(2) and V(3) applied to devices on the second and third columns are calculated by $$V(2)=V(1)-R2\times(If-if(1))$$

$$V(3)=V(2)-R3\times(If-if(1)-if(2))$$

Hence, a voltage V(k) applied to devices on the kth column (note that k≦m/2) can be calculated by $$V(k)=V(k-1)=Rk\times(If-\Sigma if(j))$$

$$(j=1 \text{ to } k-1) \tag{2}$$

A voltage applied to devices on the kth column is lower than Vf by $$Vf-V(k)=Vf-V(k-1)+Rk\times($$

$$\text{If}-\Sigma\text{if}(j))\ (j=1 \text{ to } k-1)=Vf-V($$

$$\text{k}-2)+Rk-1\times(If-\Sigma if(j)+Rk=(If-\Sigma if(j)))$$

(the first $\Sigma if(j)$ is the sum of $j=1$ to $j=k-2$, and the second $\Sigma if(j)$ is the sum of $$j=1 \text{ to } j=k-1)=If\times(R1+R2+\ldots Rk)-(R2\times if(1)+$$

$$\text{R3}\times(if(1)+if(2)+\ldots+Rk\times\Sigma if(j)))\ (j=1 \text{ to } k-1) \tag{3}$$

Figure 29A:
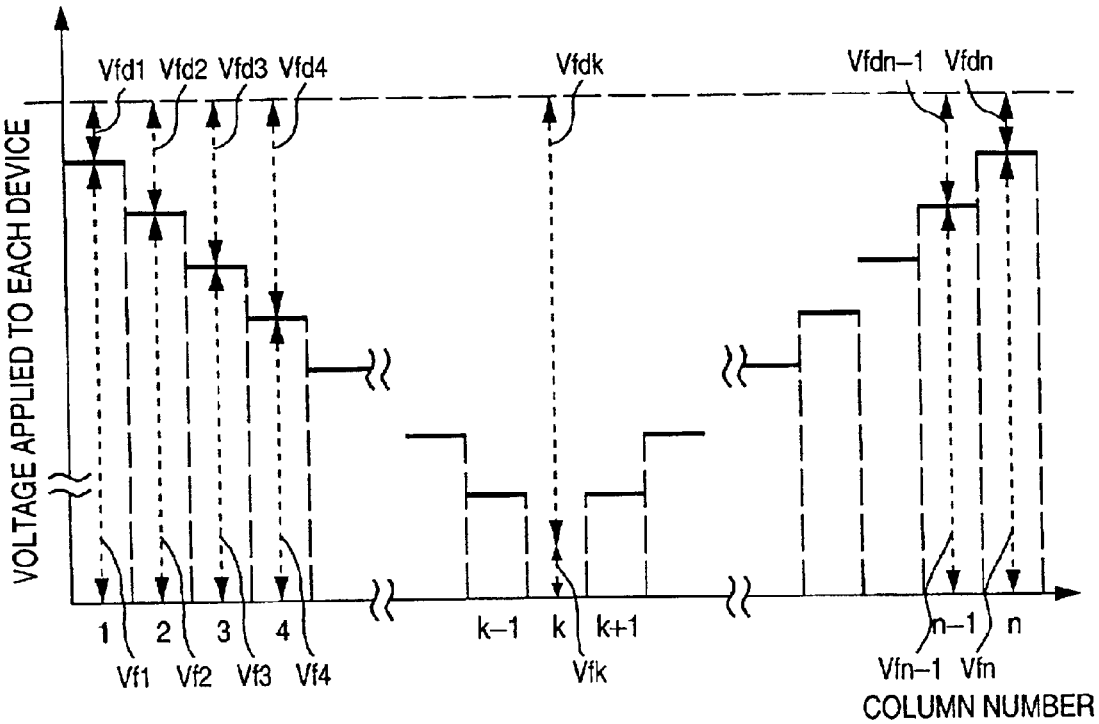
FIGS. 29A and 29B are graphs for explaining a voltage applied to each device in activation processing and a compensation voltage applied from a column wiring.
Figure 29B:
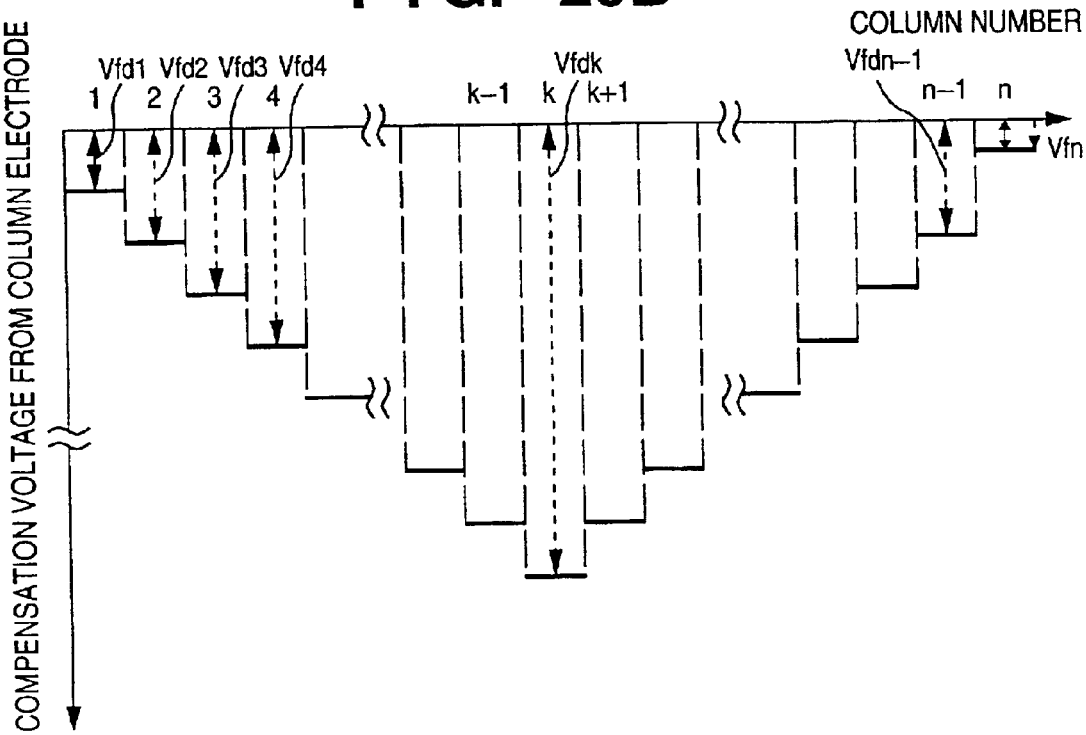
Figure 30:
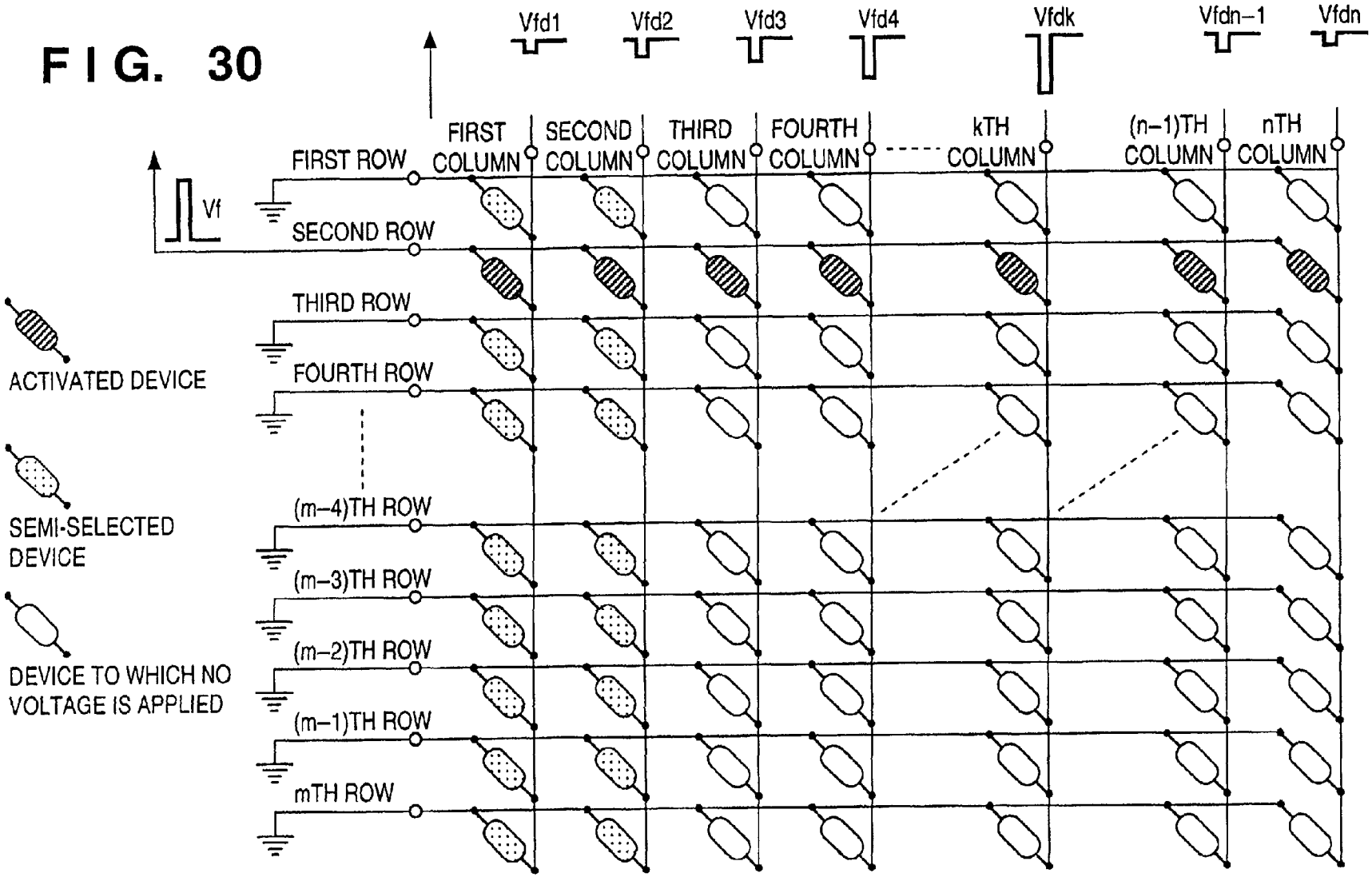
FIG. 30 is a circuit diagram for explaining a device which is selected and activated in activation processing and a device half selected by the compensation voltage.

The voltage value Vfdk shown in FIGS. 29A and 29B corresponds to the voltage drop (Vf−V(k)). A voltage corresponding to this voltage drop is applied to a column wiring to activate devices while compensating for the voltage drop caused by the wiring resistance.

The wiring resistances R1, R2, R3, . . . , Rn are determined by measuring actual resistances. The current If flowing through the ith row and the current If(j) flowing through the jth column can be respectively measured by the line-side current detection unit 110 and pixel-side current detection unit 107 during activation. If these currents If and if(j) are measured during activation, a compensation voltage corresponding to the activation state can be determined and applied.

The procedures of activating the electron source substrate 101 using the activation apparatus of the first embodiment will be explained.

To activate surface-conduction type emission devices on the first row of the substrate 101, the control unit 104 outputs a signal to the line selection unit 102 so as to select the first row wiring. As shown in FIG. 2A, the line selection unit 102 turns on only the switch SWx1 to apply a voltage pulse from the power source 103 to the first row, as shown in FIG. 2A. The voltage pulse is output to the wiring Sx1 and applied to devices connected to the first row wiring of the substrate 101 via the substrate terminal. Dx1.

Figure 6A:
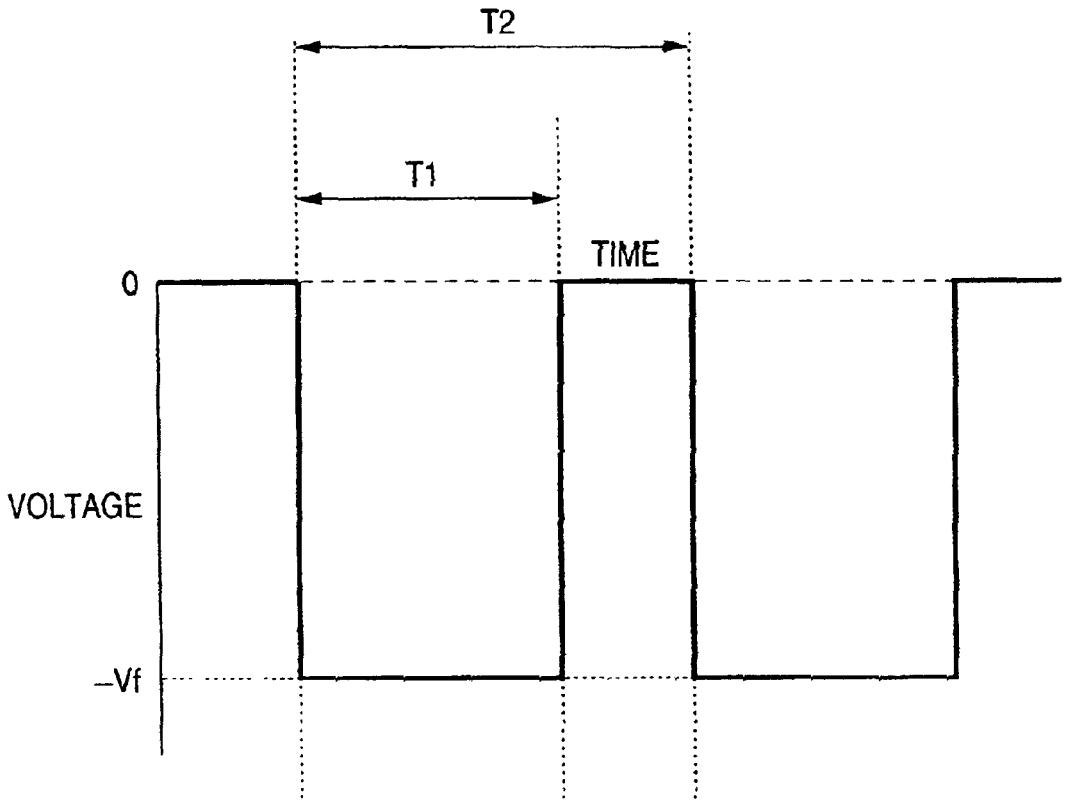
FIGS. 6A and 6B are waveform charts each showing the V-t characteristic of an application voltage pulse for activation in the embodiment.
Figure 27:
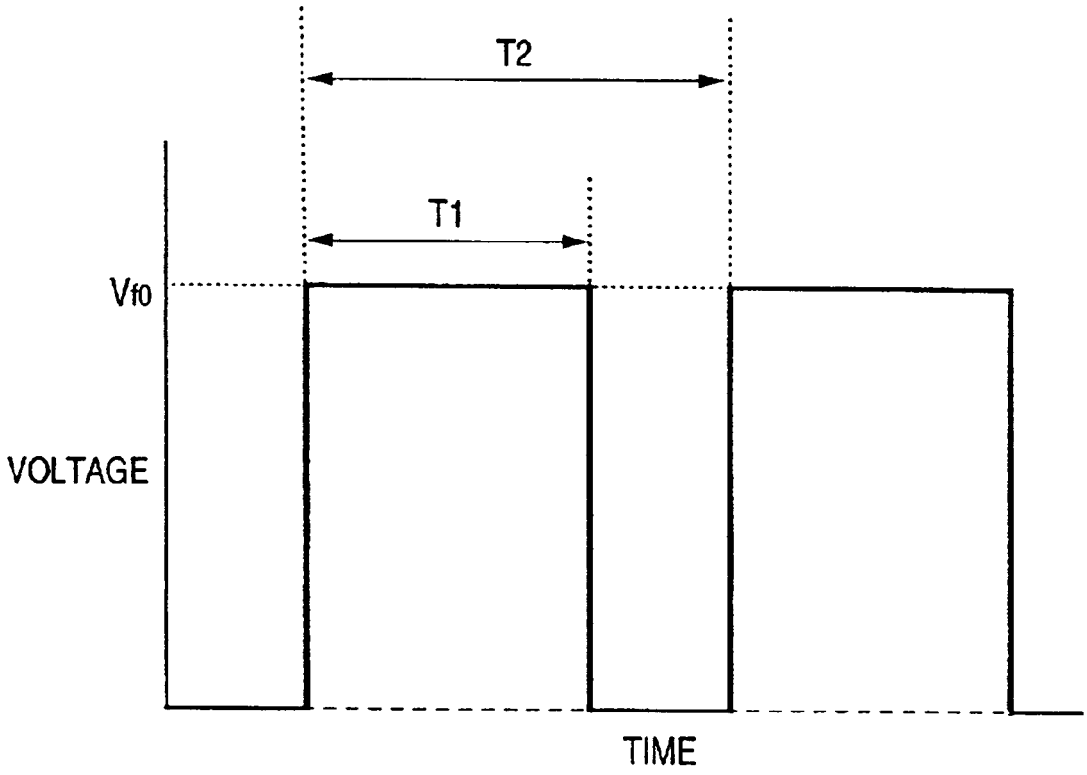
FIG. 27 is a waveform chart showing the waveform of an application voltage signal in activation processing.
Figure 28:
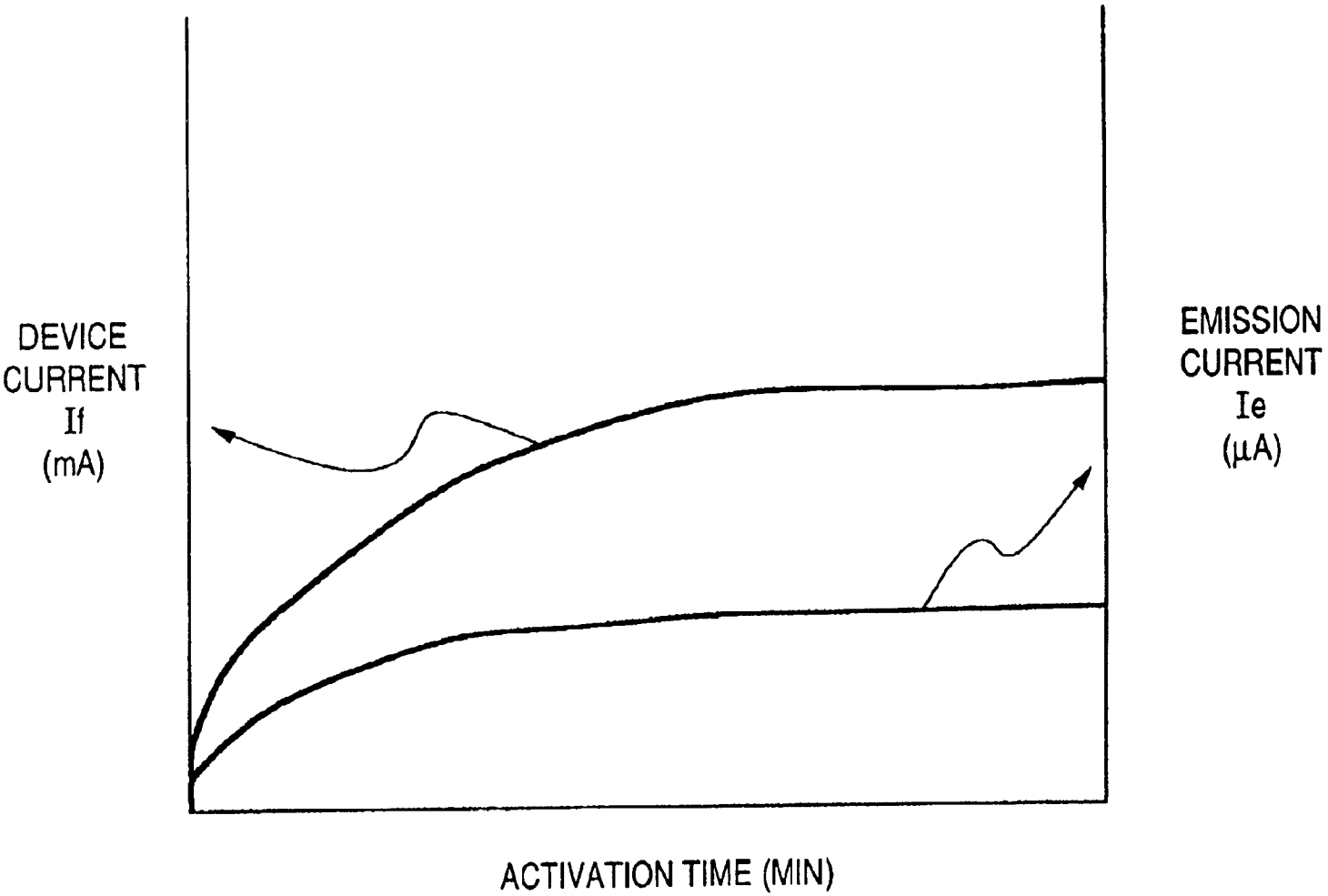
FIG. 28 is a graph showing the relationship between the lapse of time and device current in activation processing.

The voltage waveform at this time is shown in FIG. 6A. In the first embodiment, a pulse width T1 and period. T2 are 1 msec and 10 msec, respectively. The voltage value Vf in FIG. 6A is equal to Vf shown in FIG. 27.

At the same time, the control unit 104 outputs a signal to the pixel-side selection unit 111*a* so as to select all pixels (all devices on one line). Then, all the switches SWy1 to SWyn of the pixel-side selection unit 111*a* are turned on. An output voltage waveform Vassist_j (j=1 to n) (FIG. 6B) of the pixel-selection-side output voltage amplifier 111 is applied to all column wirings via the column wiring terminals Dy1 to Dyn of the electron source substrate 101.

Figure 6B:
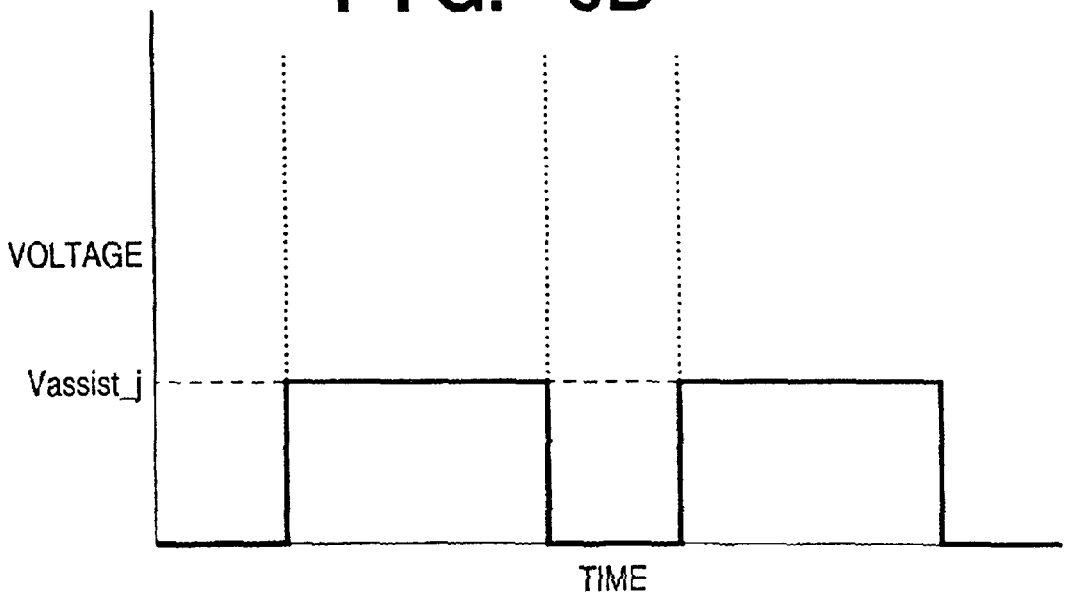

A driving voltage waveform along the jth column that is generated by the pixel-selection-side output voltage amplifier 111 is shown in FIG. 6B. The pulse width T1 and period T2 are the same as those in FIG. 6A, and pulse signals are output at the same timing. Vassist_j (j=1 to n) represents a voltage which is determined in consideration of the influence of a voltage drop on the column wiring and applied to each device connected to each column wiring of the row. As a result, the constant voltage Vf (determined by the difference between the voltage [−Vf] shown in FIG. 6B and the voltage [Vassist] shown in FIG. 6A) is applied to all the devices connected to the row wiring.

Pulses of the activation voltage Vf are applied to all devices on the first row of the electron source substrate 101 n accordance with outputs from the power source 103 and pixel-selection-side output voltage amplifier 111, thereby starting activating the devices on the first row.

However, if the voltage is kept applied to each column wiring, the voltage Vassist_j applied from the column wiring is kept applied to all devices connected to the second and subsequent row wirings. The devices decrease in resistance owing to the above-described VCNR characteristic of the devices, and flow a reactive current.

A method of preventing a decrease in resistance of the multi electron source that has been invented by the present inventors will be explained with reference to FIG. 31.

When a voltage pulse having a voltage drop rate (pulse fall) of 10 V/sec or more is applied to a low-resistance surface-conduction type emission device, the device changes to a high-resistance state different from the I-V static characteristic made up of the ranges A and B in FIG. 31.

The high-resistance state means a state in which the device follows an I-V characteristic along the dynamic characteristic shown in FIG. 31. For example, immediately: after a voltage pulse having a peak value Vd and a voltage drop rate of 10 V/sec or more is applied to a surface-conduction type emission device having the I-V characteristic in FIG. 31, the I-V characteristic of the device exhibits a high-resistance state indicated by If(Vd) in FIG. 31. Even after the device changes to the high-resistance state, the device can flow an emission current is upon applying Vd to the device. Moreover, as being apparent from the characteristic represented by the solid line If(Vd), even if a voltage Ve or less is applied to the device, the current If flowing through the device is greatly reduced in comparison with the static characteristic represented by the dotted line. The device holds this high-resistance state for a finite time (this time will be referred to as Thr) after applying the voltage pulse, and then returns to the I-V static characteristic shown in FIG. 31. When the high-resistance state must be maintained for a desired period, the voltage pulse is applied again while the high-resistance state is held. Accordingly, the holding time of the high-resistance state can be prolonged to a desired period.

According to the first embodiment, the I-V characteristic of the device is changed to a different state by applying a voltage pulse (to be referred to as a resistance increase pulse) having a voltage drop rate of 10 V/sec or more on the electron source substrate 101 having the I-V static characteristic. In other words, by changing the device to the high-resistance state, the reactive current flowing through the half selected device can be decreased to greatly reduce the power consumption of the apparatus in activation processing. Note that the upper limit of the voltage drop rate of the resistance increase pulse is practically $10^{10}$ V/sec.

The above-mentioned characteristic of the surface-conduction type emission device can prevent a decrease in resistance of a half selected device by applying a resistance increase pulse to the whole electron source substrate 101. Devices can be activated without deteriorating or destructing the whole electron source substrate 101. That is, the low-resistance state of the surface-conduction type emission device can be detected by a current value, and the resistance increase pulse is applied to the low-resistance device to activate it.

A method of detecting a low-resistance device and a method of applying a resistance increase pulse in the first embodiment will be explained.

Assume that a row wiring being activated is the ith row. When devices are activated in units of rows, the activation current can be measured by the line-side current detection unit 110 and pixel-selection-side current detection unit 107. The line-side current detection unit 110 measures a current flowing through the selected row wiring. Let If_line_i (i=1, 2, . . . , m) be the line-side current at this time. The pixel-selection-side current detection unit 107 can measure a current value flowing through each device of the selected row wiring. Let If_gaso_j (j=1, 2, 3, . . . , n) be the pixel-selection-side current at this time.

When the resistance of an unselected device does not decrease even after a voltage is applied from the pixel selection side to the device, $$If_line_i = If_gaso_1 + If_gaso_2 + If_gaso_3 + \ldots + If_gaso_n = \Sigma If_gaso_j \ (j=1 \text{ to } n) \quad (4)$$

However, as the resistance of the unselected device typically decreases by the pixel-selection-side voltage, the leakage current of the device connected to the column wiring increases. The line-side current If_line_i results in $$If_line_i < \Sigma If_gaso_j \ (j=1 \text{ to } n) \quad (5)$$

The magnitude of a leakage current If_leak_i on the column wiring when the ith row is activated is calculated by $$If_leak_i = (\Sigma If_gaso_j) - If_line_i \ (=1 \text{ to } n) \quad (6)$$

Using this leakage current If_leak_i, the low-resistance states of all surface-conduction type emission devices arranged in a simple matrix can be inspected.

In the first embodiment, a resistance increase pulse is applied only when the level of the leakage current If_leak_i exceeds a given threshold If_refresh_th. Note that the leakage current threshold If_refresh_th is several hundred μA to several A, and changes depending on the device material and manufacturing process.

Figure 7:
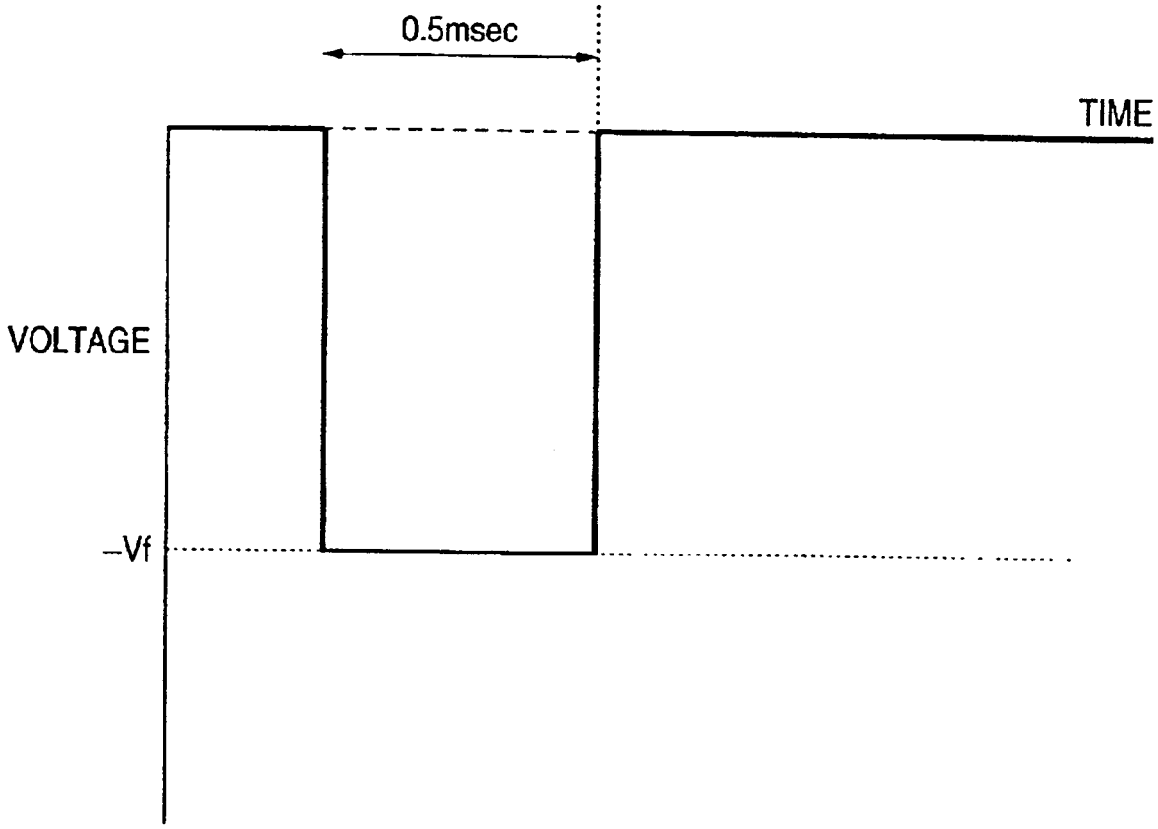
FIG. 7 is a waveform chart showing the V-t characteristic of a resistance increase pulse in the embodiment.

The resistance increase pulse in the first embodiment is shown in FIG. 7. This resistance increase pulse is generated by the power source 103. At this time, the line selection unit 102 is controlled to select all row wirings. Meanwhile, all the switches of the pixel-side selection unit 111*a* are turned off to ground all the column wirings. Alternatively, the resistance increase pulse may be applied by selecting all the column wirings by the pixel-side selection unit 111*a* and grounding all row wirings connected to the line selection unit 102.

In this manner, devices connected to the first row wiring are activated while the resistances of half selected devices are increased. Then, the control unit 104 outputs a signal to the line selection unit 102 so as to select the next row. Similar to the first row wiring, devices connected to the selected row wiring are activated, while a resistance increase pulse is applied to the remaining unselected row wirings. At the activation end time or when the activation current value reaches a target value, activation of the devices connected to the second row wiring ends.

By these procedures, respective row wirings are sequentially selected and activated. Then, activation of the electron source substrate 101 ends.

Figure 8:
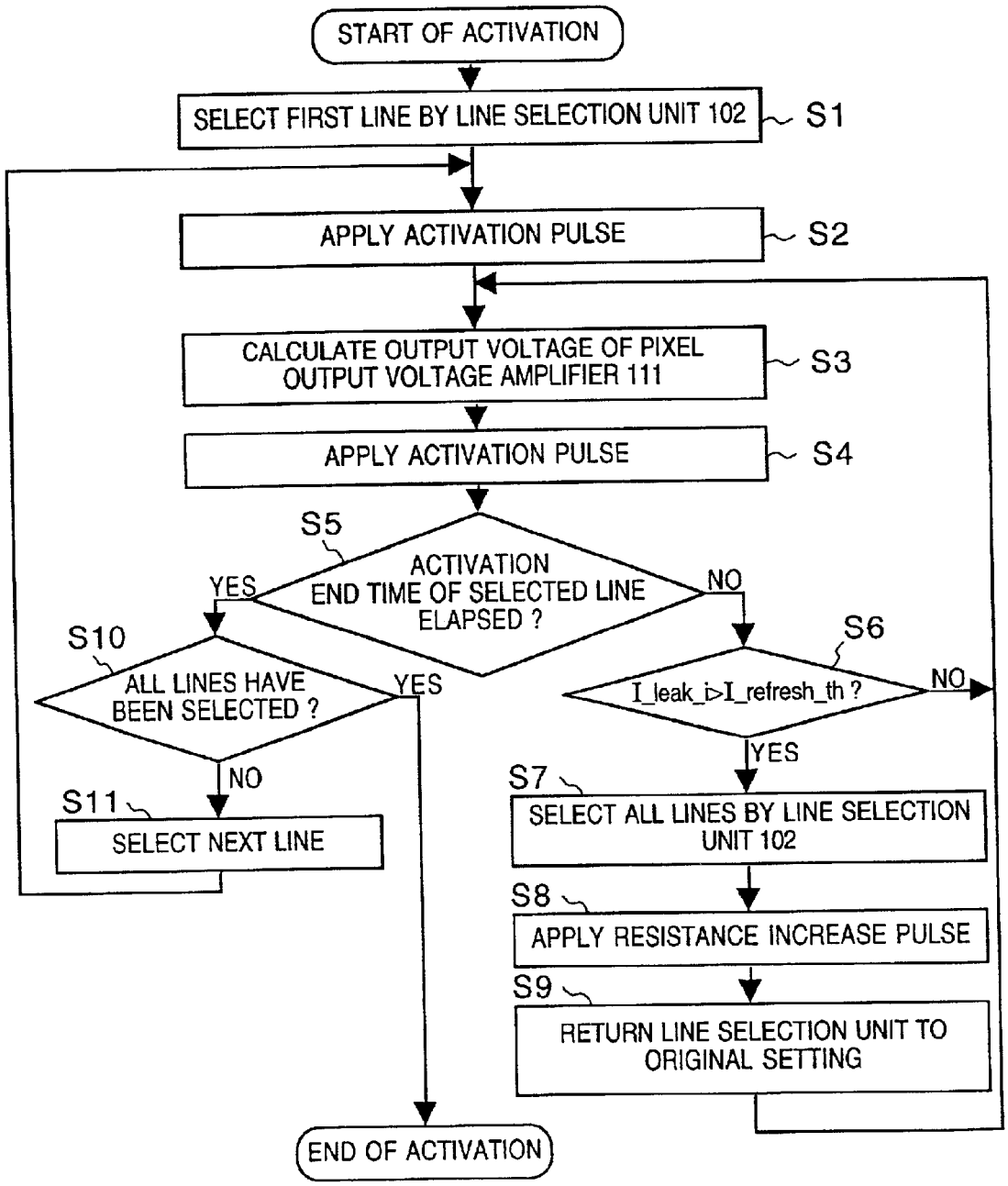
FIG. 8 is a flow chart showing activation processing by a control unit according to a first embodiment of the present invention.

FIG. 8 is a flow chart showing the processing operation of the control unit 104 of the activation apparatus according to the first embodiment.

The first row wiring is selected by the line selection unit 102 in step S1, and a pulse signal like the one shown in FIG. 6A is output from the power source 103 in step S2. In step S3, a voltage value for compensating for a voltage drop caused by the wiring resistance is calculated based on a current value flowing through the first row wiring that is measured upon application of the activation pulse in step S2, and the current value of a column wiring detected by the pixel-selection-side current detection unit 107. The flow advances to step S4 to output a pulse signal like the one shown in FIG. 6A from the power source 103. In synchronism with this, the pixel-selection-side output voltage amplifier 111 outputs a compensation voltage pulse like the one shown in FIG. 6B. Accordingly, the uniform voltage Vf is applied to all the devices connected to the first row wiring of the substrate 101. Then, the current I_line_i (current flowing through the ith row wiring) of the row activated in this step, and the currents I_gaso_j (j=1, 2, . . . , n) flowing into all the column wirings are measured.

The flow advances to step S5 to check whether a time for device activation processing is elapsed. If NO in step S5, the flow proceeds to step S6 to check the device resistance of an unselected device. Step S6 will be explained in detail. The leakage current I_leak_i measured in step S4 is compared with the threshold I_refresh_th. If I_leak_i≦I_I_refresh_th, the device resistance is determined not to decrease so much. Thus, the flow returns to step S3 to activate devices again.

If I_leak_i>I_refresh_th in step S6, the resistance of the unselected device is decreasing. Thus, the flow advances to step S7 to select all the row wirings by the line selection unit 102 and ground all the switches of the pixel-side selection unit 111*a*. The flow advances to step S8 to increase the resistances of all the devices by a resistance increase pulse generated by the power source 103. The flow proceeds to step S9 to return the settings of the line selection unit 102 and pixel-side selection unit 111*a* to states before the resistance increase pulse was applied. Then, the flow returns to step S3 to activate devices again.

If YES in step S5, the flow proceeds to step S10 to check whether all the row wirings of the substrate 101 have been processed. If NO in step S10, the flow proceeds to a step S11 to select the next row wiring by the line selection unit 102. Then, the flow returns to step S2 to execute the above processing.

As described above, according to the first embodiment, the level of the leakage current of a half selected device is detected for all devices arranged in a matrix. Devices are activated while the resistance of an unselected device is increased. This can reduce application power used in activation processing. Hence, the surface-conduction emission type device can be more efficiently prevented from being thermally destructed, and the power consumption of the activation apparatus can be reduced.

When surface-conduction type emission devices arranged in a matrix were activated using the activation apparatus of the first embodiment, the electron-emitting characteristics of all the devices were made almost uniform. Using this electron source substrate, a high-quality image display apparatus almost free from any variations in luminance or density could be realized.

The surface-conduction type emission device substrate of this embodiment is of a one-side wiring extraction type. The present invention can also be applied to a surface-conduction type emission device substrate of a two-side wiring extraction type. Even using this surface-conduction type emission device substrate, a high-quality image display apparatus could be realized.

Second Embodiment

The second embodiment detects, in units of column wirings, the low-resistance phenomenon of unselected devices that occurs in activating devices while compensating for a voltage drop caused by wiring surface-conduction type emission devices in a matrix. When the low-resistance phenomenon of devices is detected, a resistance increase pulse is applied in units of column wirings to activate the devices.

The second embodiment according to the present invention will be described in detail.

An activation apparatus in the second embodiment has the same arrangement as in the first embodiment, and a surface-conduction type emission device is also identical to that in the first embodiment. Thus, a description of the whole apparatus arrangement will be omitted.

The second embodiment is different from the first embodiment in a method of detecting a low-resistance device among surface-conduction type emission devices and a method of applying a resistance increase pulse. In the second embodiment, the position of a low-resistance device is detected in units of column wirings, and a resistance increase pulse is applied to only a column wiring connected to the low-resistance device.

Processing for detecting a low-resistance device will be explained.

A method of measuring a leakage current If_leak_i and pixel-selection-side current If_gaso_j (j=1, 2, . . . , n) while activating the ith row is the same as in the first embodiment.

When the value of the leakage current If_leak_i exceeds the value of a pixel-selection-side current If_refresh_th, the resistances of column wirings are measured to specify a column wiring connected to a low-resistance device.

In this case, all the row wirings are grounded by a line selection unit 102, and all the pixel-selection-side wirings to be measured except for the jth column wiring are grounded by a pixel-side selection unit 111*a*. A voltage V4 (V) is applied to the jth column wiring. At this time, the current If_gaso_j flowing through the jth column wiring is given by $$If_gaso_j = V4/Rsyj$$

Only when this current value If_gaso_j is larger than a column-direction leakage current threshold I_refresh_retu_th, a resistance increase pulse is applied to increase the resistance of the device.

Note that the leakage current threshold I_refresh_retu_th is several hundred μA to several A, and changes depending on the device material and manufacturing process.

The resistance increase pulse in the second embodiment is shown in FIG. 7. This resistance increase pulse is generated by a power source 156 included in a pixel-selection-side output voltage amplifier 111. At this time, all the column wirings are grounded by the line selection unit 102. Also in this process, a column wiring which requires a resistance increase pulse is selected, whereas the remaining column wirings are grounded. That is, a resistance increase pulse is applied to only a column wiring connected to a low-resistance device. This can suppress application power by the resistance increase pulse, compared to the first embodiment.

After the first row has been activated, a control unit 104 outputs a signal to the line selection unit 102 so as to select the next row. The selected row is activated by the same procedures as those of the first row. When the activation end time and activation current value reach target values, activation processing for the row wiring ends. By these procedures, devices connected to respective row wirings are sequentially activated, thereby completing activation processing for all devices of the electron source substrate 101.

Figure 9:
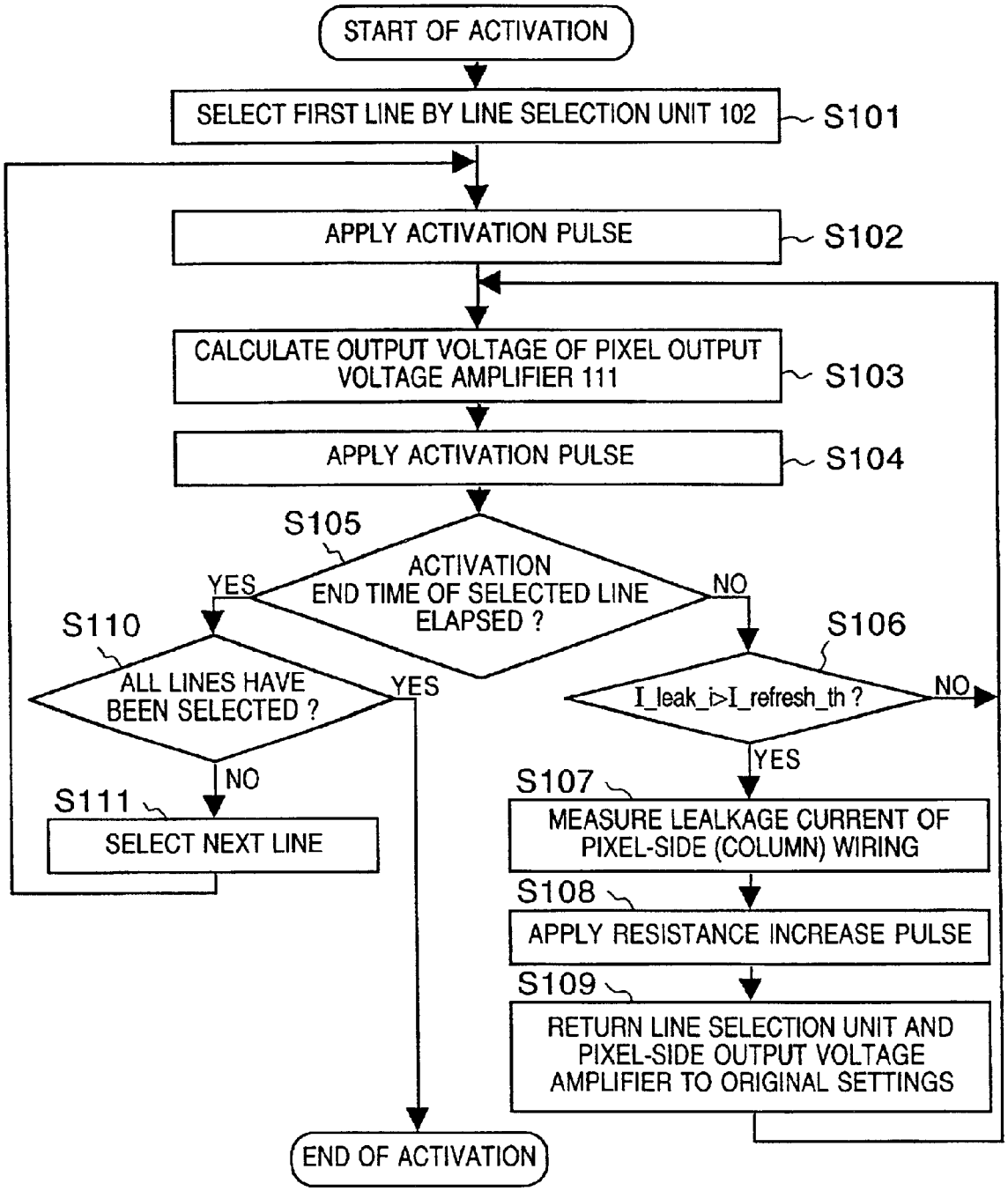
FIG. 9 is a flow chart showing activation processing by the control unit according to a second embodiment of the present invention.

FIG. 9 is a flow chart showing the processing operation of the control unit 104 of the activation apparatus according to the second embodiment.

The first row wiring is selected by the line selection unit 102 in step S101. The flow advances to step S102 to output a pulse signal like the one shown in FIG. 6A from a power source 103. The flow advances to step S103 to calculate by the control unit 104 a voltage value for compensating for a voltage drop caused by the wiring resistance, on the basis of a current value flowing through the first row wiring that is measured upon application of the activation pulse in step S102, and a current value flowing through a column wiring that is measured by a pixel-selection-side current detection unit 107. The flow advances to step S104 to output a pulse signal like the one shown in FIG. 6A from the power source 103. In synchronism with this, the pixel-selection-side output voltage amplifier 111 outputs a compensation voltage pulse like the one shown in FIG. 6B on the basis of the calculation result in step S103. Accordingly, a uniform voltage Vf is applied to all the devices connected to the first row wiring of the substrate 101. In step S104, a current I_line_i (current value flowing through the ith row wiring) flowing through the row wiring being activated, and the current I_gaso_j (j=1, 2, . . . , n) flowing into each column wiring are measured.

The flow advances to step S105 to check based on the lapse of time whether devices connected to the row wiring have been activated. If NO in step S105, the flow proceeds to step S106 to check the device resistance of an unselected device. Processing in step S106 will be explained in detail. The leakage current I_leak_i measured in step S104 is compared with the threshold I_refresh_th. If the leakage current is equal to or smaller than the threshold current (I_leak_i≦I_refresh_th), the device resistance is determined not to decrease so much. Thus, the flow returns to step S103 to activate devices again.

If the leakage current is larger than the threshold current (I_leak_i>I_refresh_th), the resistance of the unselected device is decreasing. Thus, the flow advances to step S107 to ground all the row wirings by the line selection unit 102. The pixel-side selection unit 111*a* selects column wirings one by one and applies a voltage to them. Current values flowing through the respective column wirings are detected to specify a column wiring connected to the low-resistance device. Then, the flow advances to step S108. While all row wirings are grounded by the line selection unit 102, a resistance increase pulse is applied to the low-resistance column wiring detected in step S107 from the power source 156 connected to the pixel-selection-side output voltage amplifier 111. This increases the resistance of the device connected to the column wiring. The flow proceeds to step S109 to return the settings of the line selection unit 102 and pixel-side selection unit 111*a* to states before the resistance increase pulse was applied. Then, the flow returns to step S103 to activate devices again.

If YES in step S105, the flow proceeds to step S110 to check whether all row wirings have been activated. If NO in step S110, the flow proceeds to step S111 to select the next row wiring by the line selection unit 102. Then, the flow returns to step S102 to execute the above processing.

As described above, according to the second embodiment, the level of the leakage current of a half selected device is detected in units of column wirings. Devices are activated while a resistance increase pulse is applied to a column wiring flowing a large leakage current. This can reduce application power used in activation processing. Consequently, the surface-conduction type emission device can be more efficiently prevented from being thermally destructed, and the power consumption of the activation apparatus can be reduced.

When surface-conduction type emission devices arranged in a matrix were activated using the activation apparatus of the second embodiment, the electron-emitting characteristics of all the devices were made almost uniform. An image display apparatus was manufactured using an electron source having these surface-conduction type emission devices, and could form a high-quality image almost free from any variations in luminance or density.

Note that the surface-conduction type emission device substrate of the second embodiment is of a one-side wiring extraction type. The present invention can also be applied to a surface-conduction type emission device substrate of a two-side wiring extraction type. Even using this surface-conduction type emission device substrate, a high-quality image display apparatus could be realized.

Third Embodiment

The third embodiment detects, in units of devices, the low-resistance phenomenon of unselected devices that occurs in activating devices while compensating for a voltage drop caused by wiring surface-conduction type emission devices in a matrix. When the low-resistance phenomenon of devices is detected in units of devices, a resistance increase pulse is applied in units of devices to activate them.

The third embodiment according to the present invention will be described in detail.

An activation apparatus in the third embodiment has the same arrangement as in the first embodiment, and a surface-conduction type emission device substrate is also identical to that in the first embodiment. Thus, a description of the whole apparatus arrangement will be omitted.

The third embodiment is different from the first embodiment in a method of detecting a low-resistance device among surface-conduction type emission devices and a method of applying a resistance increase pulse. In the third embodiment, a low-resistance device is detected in units of devices, and a resistance increase pulse is applied in units of devices.

Processing for detecting a low-resistance device will be explained.

Processing of measuring a leakage current If_leak_i and pixel-selection-side current If_gaso_j (j−1, 2, . . . , n) while activating devices connected to the ith row wiring is the same as in the first embodiment.

When the value of the leakage current If_leak_i exceeds a threshold current If_refresh_th, device resistances are measured to specify a low-resistance device.

To specify a low-resistance device, all the row wirings are grounded by a line selection unit 102, and all the pixel-selection-side wirings, i.e., all the column wirings to be measured except for the jth column wiring are grounded by a pixel-side selection unit 111*a*. A voltage V5 (V) is applied to the Jth column wiring. At this time, a current If_line_i flowing through the ith row wiring is given by $$If_line_i = V5/Rsxi$$

Only when this current If_line_i is larger than a single-device leakage current threshold I_refresh_sosi_th, a resistance increase pulse is applied to a corresponding device to increase the resistance of the device. Note that this leakage current threshold I_refresh_sosi_th is several hundred $\mu$A to several A, and changes depending on the device material and manufacturing process.

Figure 10:
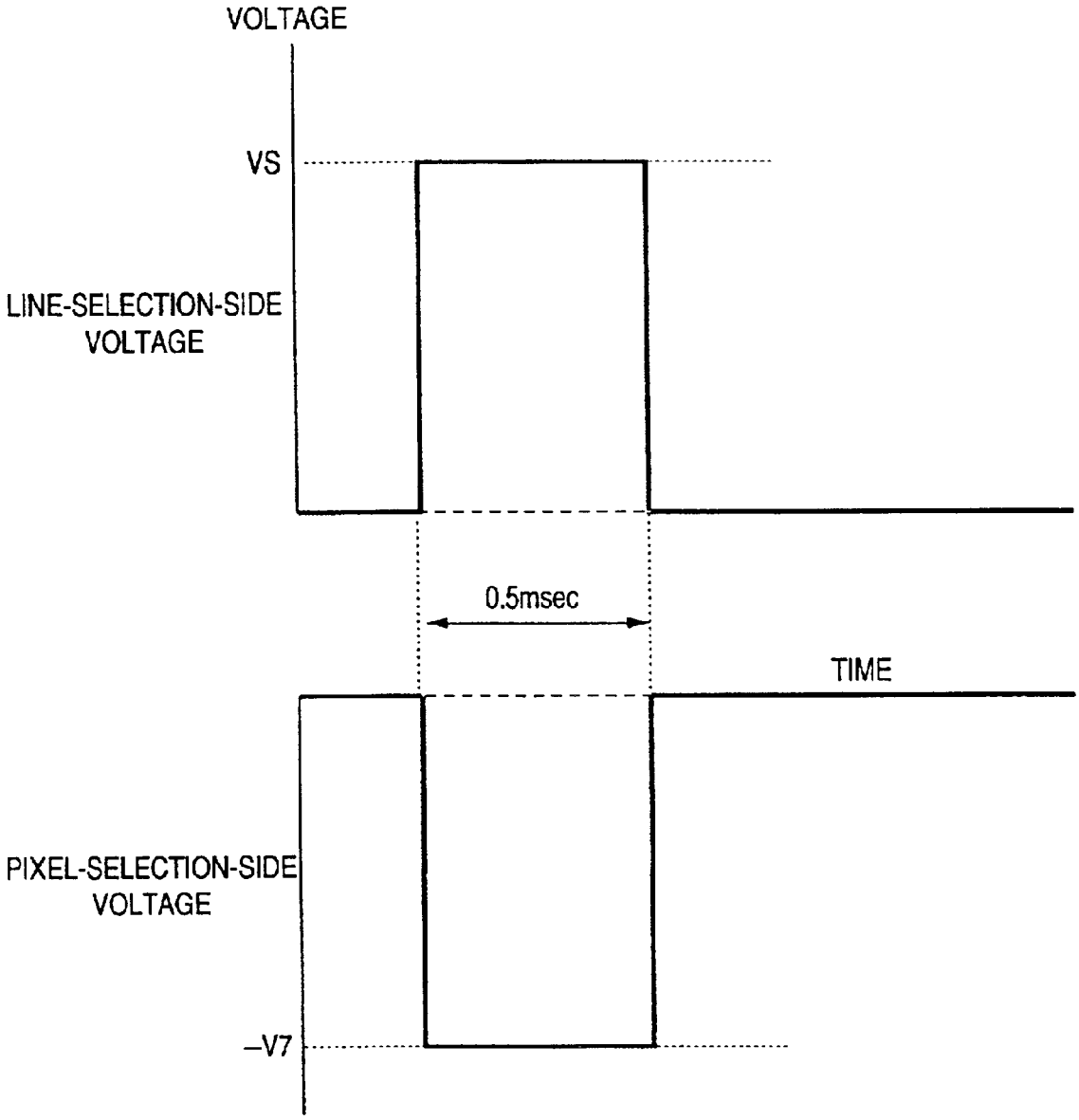
FIG. 10 is a waveform chart showing the V-t characteristic of the resistance increase pulse in a third embodiment.

The waveform of the resistance increase pulse in the third embodiment is shown in FIG. 10.

This resistance increase pulse is generated by a power source 103 for generating a voltage to be applied to a row wiring, and a power source 156 connected to a pixel-selection-side output voltage amplifier 111. To increase the resistances of devices on the ith row and jth column, a resistance increase pulse is applied while the remaining row wirings and column wirings except for the ith row wiring and jth column wiring are grounded. A voltage −V7 used to generate a resistance increase pulse is generated by the power source 156, and a voltage V8 is generated by the power source 103. These voltages must be applied to half selected devices at a high speed so as not to decrease their resistances.

In this fashion, devices connected to the first row wiring are activated while the resistances of the respective devices are increased. After that, a control unit 104 outputs a signal to the line selection unit 102 so as to select the next row wiring. Devices connected to the next row wiring are activated while a resistance increase pulse is applied to the remaining row wirings by the same procedures as those of the first row wiring. When the activation end time and activation current value reach target values, activation processing for devices connected to the row wiring ends.

After all the row wirings are sequentially selected and activated by these procedures, activation processing for the substrate 101 ends.

Figure 11:
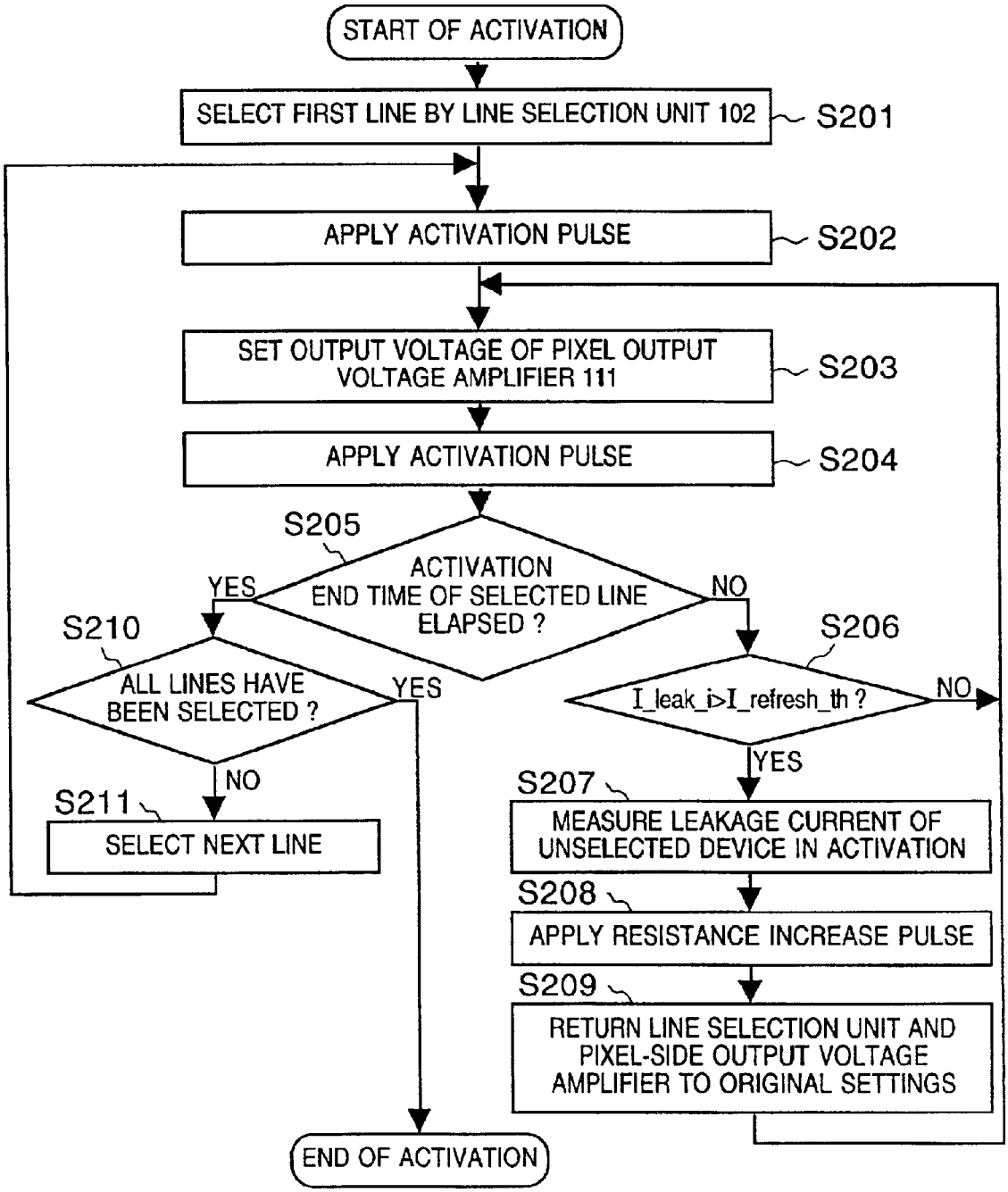
FIG. 11 is a flow chart showing activation processing by the control unit according to the third embodiment of the-present invention.

FIG. 11 is a flow chart showing the processing operation of the control unit 104 of the activation apparatus according to the third embodiment.

In step S201, the line selection unit 102 selects the first row wiring. In step S202, the control unit 104 calculates a voltage value for compensating for a voltage drop caused by the influence of the wiring resistance, and the power source 103 outputs a pulse signal like the one shown in FIG. 6A. The flow proceeds to step S203 to calculate by the control unit 104 a voltage value for compensating for a voltage drop caused by the wiring resistance, on the basis of a current value flowing through the first row wiring that is measured upon application of the activation pulse in step S202, and a current value flowing through column wiring that is measured by a pixel-selection-side current detection unit 107. The flow advances to step S204 to output a compensation voltage pulse like the one shown in FIG. 6B from the pixel-selection-side output voltage amplifier 111. Accordingly, a uniform voltage Vf is applied to all the devices connected to the first row wiring of the substrate 101. The current I_line_I (current of the ith row) flowing through the row wiring activated in this step, and the current I_gaso_j (j=1, 2, . . . , n) flowing into each column wiring are measured.

The flow advances to step S205 to check whether a time for activation processing is elapsed and whether devices connected to the row wiring have been activated. If NO in step S205, the flow proceeds to step S206 to check the device resistance of an unselected device. Processing in step S206 will be explained in detail. The leakage current I_leak_i measured in step S204 is compared with the threshold I_refresh_th. If the leakage current is equal to or smaller than the threshold (I_leak_i≦I_refresh_th), the device resistance is determined not to decrease so much. Thus, the flow returns to step S203 to activate devices again.

If the leakage current is determined in step S206 to be larger than the threshold (I_leak_i>I_refresh_th), the flow proceeds to step S207 to determine that the resistance of the unselected device is decreasing. The low-resistance device is specified by the line selection unit 102 and pixel-side selection unit 111*a*. All the row and column wirings except for the row and column wirings connected to the low-resistance device are grounded to specify the low-resistance device. Then, the flow advances to step S208 to increase the resistance of the low-resistance device specified in step S207 by applying resistance increase pulses from the power source 103 and power source 156 connected to the pixel-selection-side output voltage amplifier 111. The flow proceeds to step S209 to return the settings of the line selection unit 102 and pixel-side selection unit 111*a* to states before the resistance increase pulse was applied in step S207 and S208. Then, the flow returns to step S203 to activate devices again.

If YES in step S205, the flow proceeds to step S210 to check whether all row wirings have been activated. If NO in step S210, the flow proceeds to step S211 to select the next row wiring by the line selection unit 102. Then, the flow returns to step S202 to execute the above processing.

As described above, according to the third embodiment, the level of the leakage current of a half selected device is detected in units of devices. Devices are activated while the resistance of a low-resistance device is increased. This can reduce application power used in activation processing. The surface-conduction type emission device can be more efficiently prevented from being thermally destructed, and the power consumption of the activation apparatus can be reduced.

When surface-conduction type emission devices arranged in a matrix were activated using the activation apparatus of the third embodiment, the electron-emitting characteristics of all the devices were made almost uniform. An image display apparatus was manufactured using an electron source having these surface-conduction type emission devices arranged in a matrix, and could form a high-quality image almost free from any variations in luminance or density.

Note that the surface-conduction type emission device substrate of the third embodiment is of a one-side wiring extraction type. The present invention can also be applied to a surface-conduction type emission device substrate of a two-side wiring extraction type. Even using this surface-conduction type emission device substrate, a high-quality image display apparatus could be realized.

(Arrangement and Manufacturing Method of Display Panel)

The arrangement and manufacturing method of the display panel of an image display apparatus to which the electron source substrate of the present invention is applied will be exemplified.

Figure 12:
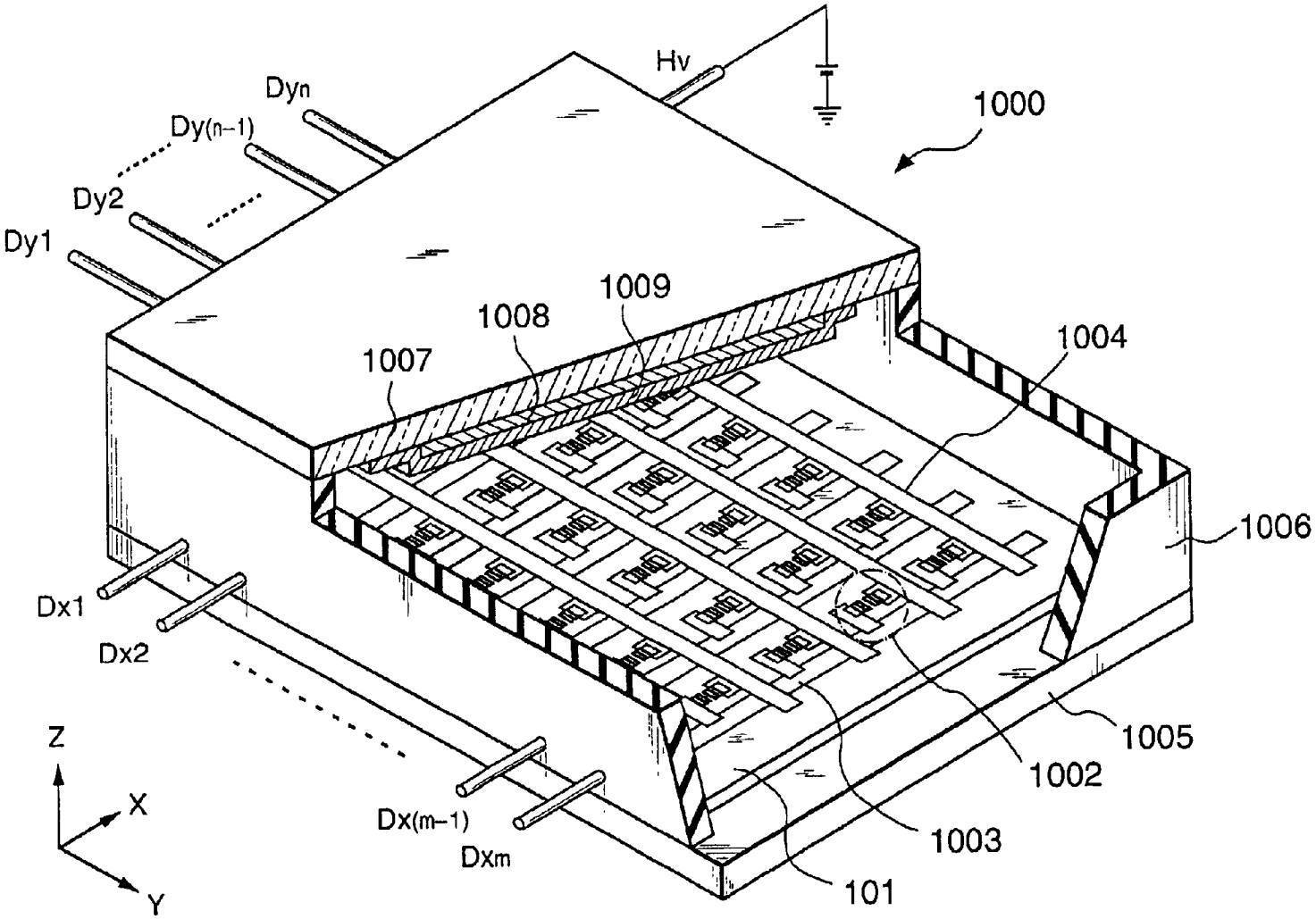
FIG. 12 is a partially cutaway perspective view showing the display panel of an image display apparatus according to the embodiment of the present invention.

FIG. 12 is a perspective view of the outer appearance of a display panel 1000 using the electron source substrate 101 according to the embodiment, showing the internal structure of the display panel 1000.

In FIG. 12, reference numeral 1005 denotes a rear plate; 1006, a side wall; and 1007, a face plate. These parts 1005 to 1007 constitute an airtight container for maintaining the inside of the display panel 1000 vacuum. To construct the airtight container, it is necessary to seal-connect the respective parts to obtain sufficient strength and maintain airtight condition. For example, frit glass is applied to junction portions, and sintered at 400 to 500° C. in air or nitrogen atmosphere, thus the parts are seal-connected. A method for exhausting air from the inside of the container will be described later.

The rear plate 1005 has a substrate 101 fixed thereon, on which n×m cold cathode devices 1002 are formed (n, m=positive integer equal to 2 or more, properly set in accordance with a desired number of pixels to be displayed. For example, in a display apparatus for high-resolution television display, preferably n=3,000 or more, m=1,000 or more. In the embodiment, n=3,072 or more, m=1,024.) The n×m surface-conduction type emission devices are arranged in a simple matrix with m row wirings 1003 and n column wirings 1004. The portion constituted by the substrate 101, electron-emitting devices 1002, and row and column wirings 1003 and 1004 will be referred to as a multi electron source. The manufacturing method and structure of the multi electron source will be described in detail later.

In this embodiment, the substrate 101 of the multi electron source is fixed to the rear plate 1005 of the airtight container. If, however, the substrate 101 of the multi electron source has sufficient strength, the substrate 101 of the multi electron source may also serve as the rear plate of the airtight container.

Figure 13A:
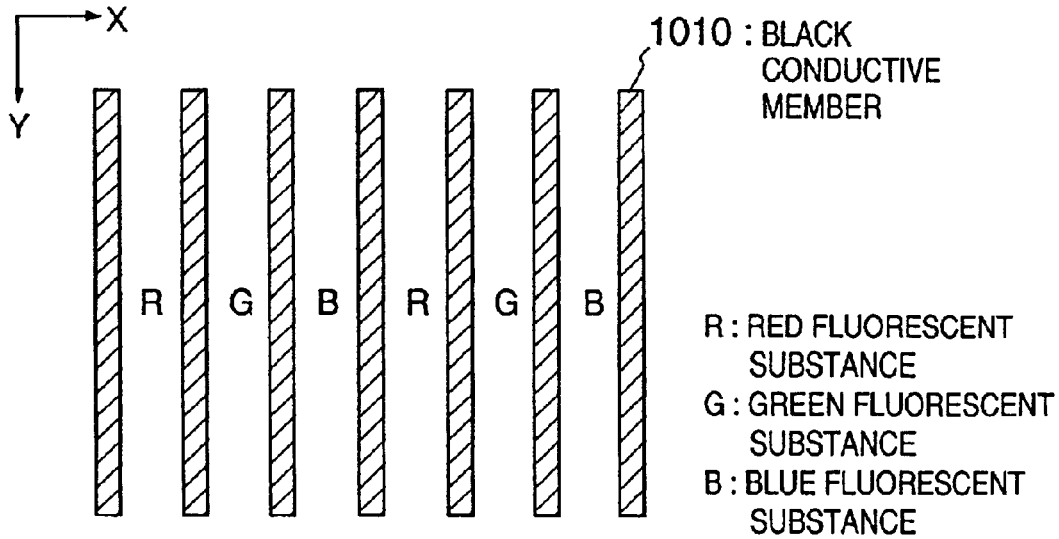
FIGS. 13A and 13B are plan views showing examples of an alignment of fluorescent substances on a face plate of a display panel according to the embodiment.

A fluorescent film 1008 is formed on the lower surface of the face plate 1007. As this embodiment is a color display apparatus, the fluorescent film 1008 is coated with red, green, and blue fluorescent substances, i.e., three primary color fluorescent substances used in the CRT field. As shown in FIG. 13A, the respective color fluorescent substances are formed into a striped structure, and black conductive members 1010 are provided between the stripes of the fluorescent substances. The purpose of providing the black conductive members 1010 is to prevent display color misregistration even if the electron-beam irradiation position is proceeded to some extent, to prevent degradation of display contrast by shutting off reflection of external light, to prevent the charge-up of the fluorescent film by the electron beam, and the like. As a material for the black conductive members 1010, graphite is used as a main component, but other materials may be used so long as the above purpose is attained.

Figure 13B:
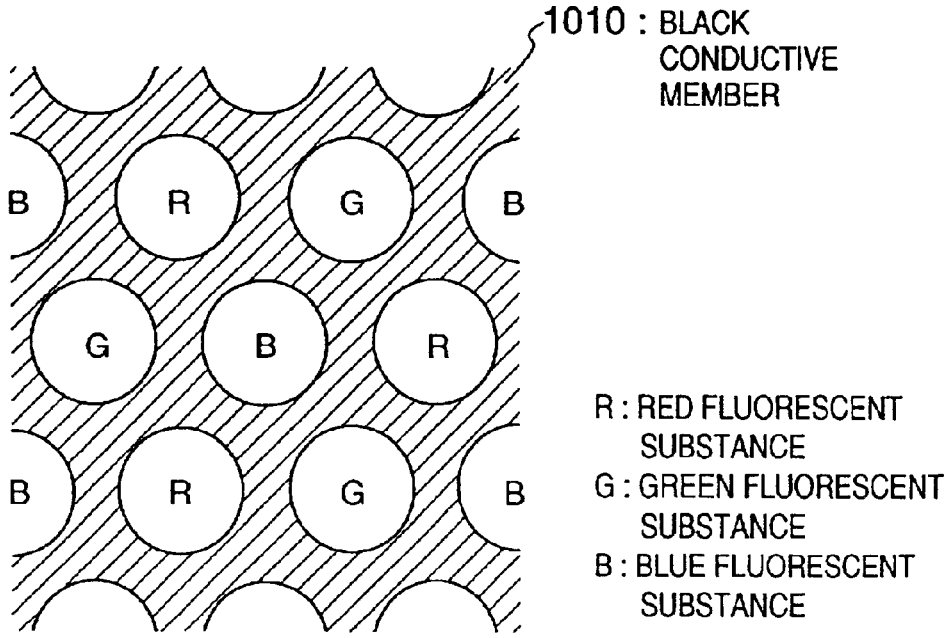

Further, three-primary colors of the fluorescent film is not limited to the stripes as shown in FIG. 13A. For example, delta arrangement as shown in FIG. 13B or any other arrangement may be employed.

Note that when a monochrome display panel is formed, a single-color fluorescent substance may be applied to the fluorescent film 1008, and the black conductive member may be omitted.

Furthermore, a metal back 1009, which is well-known in the CRT field, is provided on the fluorescent film 1008 on the rear plate side. The purpose of providing the metal back 1009 is to improve the light-utilization ratio by mirror-reflecting part of the light emitted by the fluorescent film 1008, to protect the fluorescent film 1008 from collision with negative ions, to be used as an electrode for applying an electron-beam accelerating voltage, to be used as a conductive path for electrons which excited the fluorescent film 1008, and the like. The metal back 1009 is formed by forming the fluorescent film 1008 on the face plate substrate 1007, smoothing the front surface of the fluorescent film, and depositing Al (aluminum) thereon by vacuum deposition. Note that when fluorescent substances for a low voltage is used for the fluorescent film 1008, the metal back 1009 is not used.

Furthermore, for application of an accelerating voltage or improvement of the conductivity of the fluorescent film, transparent electrodes made of, e.g., ITO may be provided between the face plate substrate 1007 and the fluorescent film 1008, although such electrodes are not used in this embodiment.

Dx1 to Dxm, Dy1 to Dyn, and Hv are electric connection terminals for an airtight structure provided to electrically connect the display panel 1000 to an electric circuit (not shown). Dx1 to Dxm are electrically connected to the row wirings 1003 of the multi electron source; Dy1 to Dyn, to the column wirings 1004 of the multi electron source; and Hv, to the metal back 1009 of the face plate.

To evacuate the airtight container, after forming the airtight container, an exhaust pipe and a vacuum pump (neither is shown) are connected, and the airtight container is evacuated to a vacuum of about $10^{-7}$ Torr. Thereafter, the exhaust pipe is sealed. To maintain the vacuum in the airtight container, a getter film (not shown) is formed at a predetermined position in the airtight container immediately before/after the sealing. The getter film is a film formed by heating and evaporating a getter material mainly consisting of, e.g., Ba, by heating or RF heating. The suction effect of the getter film maintains a vacuum of $1\times10^{-5}$ or $1\times10^{-7}$ Torr in the container.

The basic arrangement and manufacturing method of the display panel 1000 according to the embodiment of the present invention have been briefly described above.

A method of manufacturing the multi electron source used in the display panel 1000 of this embodiment will be described below. In manufacturing the multi electron source used in the image display apparatus of the present invention, the surface-conduction type emission device can employ any material, shape, and manufacturing method as long as the multi electron source is constituted by arranging surface-conduction type emission devices in a simple matrix. The basic structure, manufacturing method, and characteristics of a preferable surface-conduction type emission device used in the display panel 1000 of the embodiment will be described first. Then, the structure of the multi electron source having many devices arranged in a simple matrix will be described later.

(Preferred Structure of Surface-conduction Type Emission Device and Preferred Manufacturing Method)

Typical examples of surface-conduction type emission devices which can be applied to the embodiment include two types of devices, namely flat and step type devices.

(Flat Surface-conduction Type Emission Device)

First, the structure and manufacturing method of a flat surface-conduction type emission device will be described.

Figure 14A:
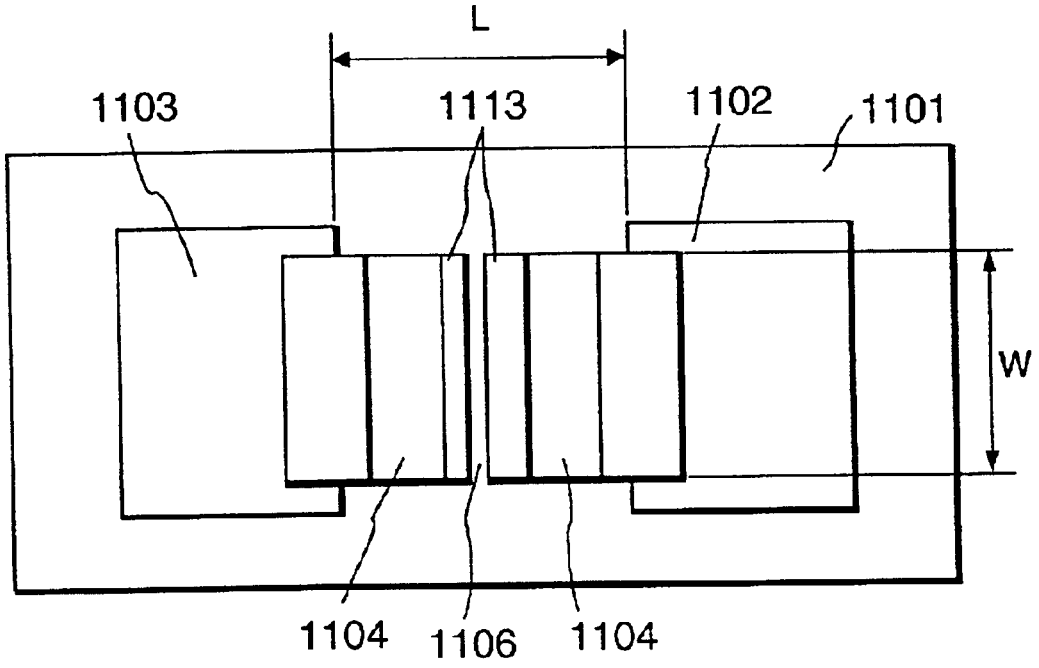
FIGS. 14A and 14B are a plan view and a sectional view, respectively, showing a planar type of surface-conduction type emission device used in the embodiment.
Figure 14B:
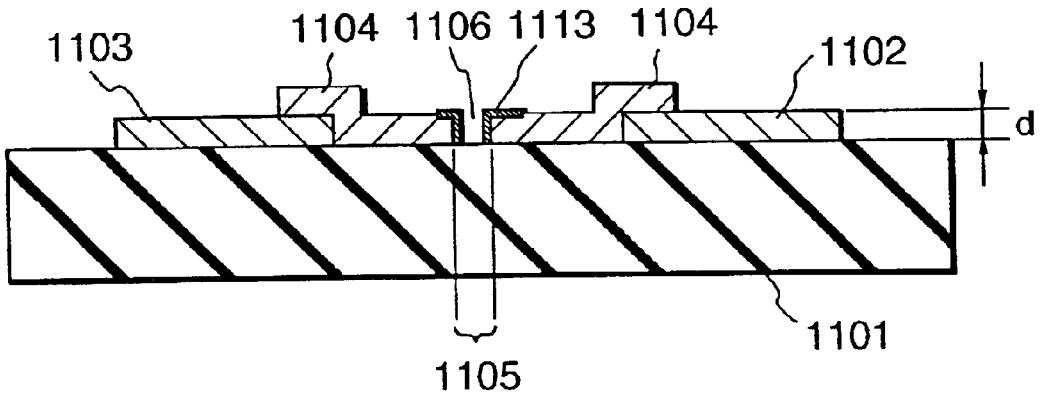

FIGS. 14A and 14B are a plan view and a sectional view, respectively, for explaining the structure of the flat surface-conduction type emission device. Referring to FIGS. 14A and 14B, reference numeral 1101 denotes a substrate; 1102 and 1103, device electrodes: 1104, a conductive thin film; 1105, a first gap such as a fissure formed by the forming processing; and 1113, a thin film formed by the activation processing. As shown in FIGS. 14A and 14B, the thin film 1113 is formed on a pair of conductive thin films 1104 and in the first gap 1105 to form a second gap 1106 narrower than the first gap 1105.

As the substrate 1101, various glass substrates of quartz glass, soda-lime glass, and the like, various ceramic substrates of alumina and the like, or any of those substrates covered with an insulating layer made of $SiO_2$ or the like can be employed.

The device electrodes 1102 and 1103, provided on the substrate 1101 to face each other in parallel with the substrate surface, are made of a conductive material. For example, any material of metals such as Ni, Cr, Au, Mo, W, Pt, Ti, Cu, Pd and Ag, or alloys of these metals, otherwise metal oxides such as $In_2O_3$—$SnO_2$, or semiconductive material such as polysilicon, can be employed. These electrodes 1102 and 1103 can be easily formed by the combination of a film-forming technique such as vacuum-evaporation and a patterning technique such as photolithography or etching, however, any other method (e.g., printing technique) may be employed.

The shape of the electrodes 1102 and 1103 is appropriately designed in accordance with an application object of the electron-emitting device. Generally, an interval L between electrodes is designed by selecting an appropriate value in a range from hundreds Å to hundreds $\mu$m. Most preferable range for a display apparatus is from several $\mu$m to ten $\mu$m. As for electrode thickness d, an appropriate value is selected in a range from hundreds Å to several $\mu$m.

The conductive thin film 1104 comprises a fine particle film. The "fine particle film" is a film which contains a lot of fine particles (including masses of particles) as film-constituting members. In microscopic view, normally individual particles exist in the film at predetermined intervals, or in adjacent to each other, or, overlapped with each other.

One particle of the fine particle film has a diameter within a range from several Å to thousand Å. Preferably, the diameter is within a range from 10 Å to 200 Å. The thickness of the fine particle film is appropriately set in consideration of conditions as follows. That is, condition necessary for electrical connection to the device electrode 1102 or 1103, condition for the forming processing to be described later, condition for setting electrical resistance of the fine particle film itself to an appropriate value to be described later etc.

Specifically, the thickness of the film is set in a range from several Å to thousand Å, more preferably, 10 Å to 500 Å.

Materials used for forming the fine particle film are, e.g., metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC, and WC, nitrides such as TiN, ZrN and HfN, semiconductors such as Si and Ge, and carbons. Any of appropriate material(s) is appropriately selected.

As described above, the conductive thin film 1104 is formed with a fine particle film, and sheet resistance of the film is set to reside within a range from $10^3$ to $10^7$ (Ω/□).

As it is preferable that the conductive thin film 1104 is electrically connected to the device electrodes 1102 and 1103, they are arranged so as to overlap with each other at one portion. In FIGS. 14A and 14B, the respective parts are overlapped in order of, the substrate, the device electrodes, and the conductive thin film, from the bottom. This overlapping order may be, the substrate, the conductive thin film, and the device electrodes, from the bottom.

The fissured first gap 1105 is formed at a part of the conductive thin film 1104 to divide the conductive thin film 1004 into a pair of conductive thin films. The first gap 1105 has a resistance higher than peripheral conductive thin film. The fissure is formed by the forming processing to be described later on the conductive thin film 1104. In some cases, particles, having a diameter of several Å to hundreds Å, are arranged in the first gap 1005. As it is difficult to exactly illustrate actual position and shape of the first gap, FIGS. 14A and 14B show the first gap schematically.

The thin film 1113, which contains carbon or carbon compound material, is formed on the conductive thin film 1104 and in the first gap 1105, and has the second gap 1006 narrower than the first gap 1105. The thin film 1113 is formed by the activation processing to be described later after the forming processing.

The thin film 1113 is preferably graphite monocrystalline, graphite polycrystalline, amorphous carbon, or mixture thereof, and its thickness is 500 Å or less, more preferably, 300 Å or less.

As it is difficult to exactly illustrate actual position or shape of the thin film 1113, FIGS. 14A and 14B show the film schematically. FIG. 14A shows the device where a part of the thin film 1113 is removed.

The preferred basic structure of the surface-conduction type emission device is as described above. In the embodiment, the device has the following constituents. That is, the substrate 1101 comprises a soda-lime glass, and the device electrodes 1102 and 1103, an Ni thin film. The electrode thickness d is 1,000 Å and the electrode interval L is 2 $\mu$m.

The main material of the fine particle film is Pd or PdO. The thickness of the fine particle film is about 100 Å, and its width W is 100 $\mu$m.

Next, a method of manufacturing a preferred flat surface-conduction type emission device will be described.

FIGS. 15A to 15D are sectional views showing the manufacturing processes of the surface-conduction type emission device according to the embodiment. Reference numerals are the same as those in FIGS. 14A and 14B.

Figure 15A:
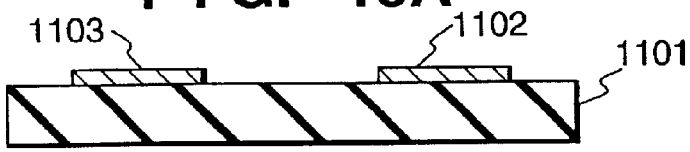
FIGS. 15A to 15E are sectional views showing the steps in manufacturing the planar type of surface-conduction type emission device according to the embodiment.

1) First, as shown in FIG. 15A, the device electrodes 1102 and 1103 are formed on the substrate 1101. In forming the device electrodes 1102 and 1103, first, the substrate 1101 is fully washed with a detergent, pure water and an organic solvent, then, material of the device electrodes is deposited there. (As a depositing method, a vacuum film-forming technique such as evaporation and sputtering may be used.) Thereafter, patterning using a photolithography etching technique is performed on the deposited electrode material. Thus, the pair of device electrodes (1102 and 1103) shown in FIG. 15A are formed.

Figure 15B:
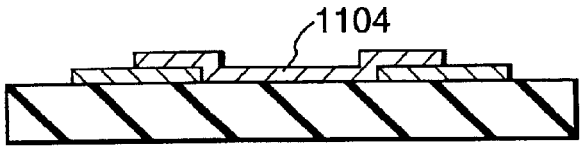

2) Next, as shown in FIG. 15B, the conductive thin film 1104 is formed. In forming the conductive thin film 1104, first, an organic metal solvent is applied to the substrate in FIG. 15A, then the applied solvent is dried and sintered, thus forming a fine particle film. Thereafter, the fine particle film is patterned into a predetermined shape by the photolithography etching method. The organic metal solvent means a solvent of organic metal compound containing material of fine particles, used for forming the conductive thin film, as main component. (More specifically, Pd is used as a main component in this embodiment. In the embodiment, application of organic metal solvent is made by dipping, however, any other method such as a spinner method and spraying method may be employed.)

As a film-forming method of the conductive thin film made with the fine particles, the application of organic metal solvent used in the embodiment can be replaced with any other method such as a vacuum evaporation method, a sputtering method or a chemical vapor-phase accumulation method.

Figure 15C:
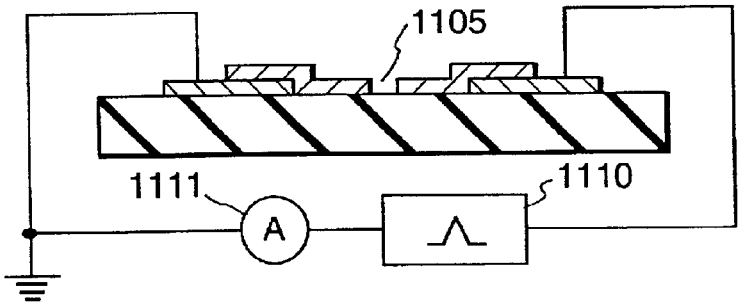

3) Then, as shown in FIG. 15C, appropriate voltage is applied between the device electrodes 1102 and 1103, from a power source 1110 for the forming processing, then the forming processing is performed, thus forming the first gap 1105.

In the forming processing, electric energization is done for the conductive thin film 1104 made of a fine particle film to properly fissure the conductive thin film, thereby forming the first gap 1105. Comparing the conductive thin film 1104 having the first gap 1105 with the conductive thin film before the forming processing, the electrical resistance measured between the device electrodes 1102 and 1103 has greatly increased.

Figure 16:
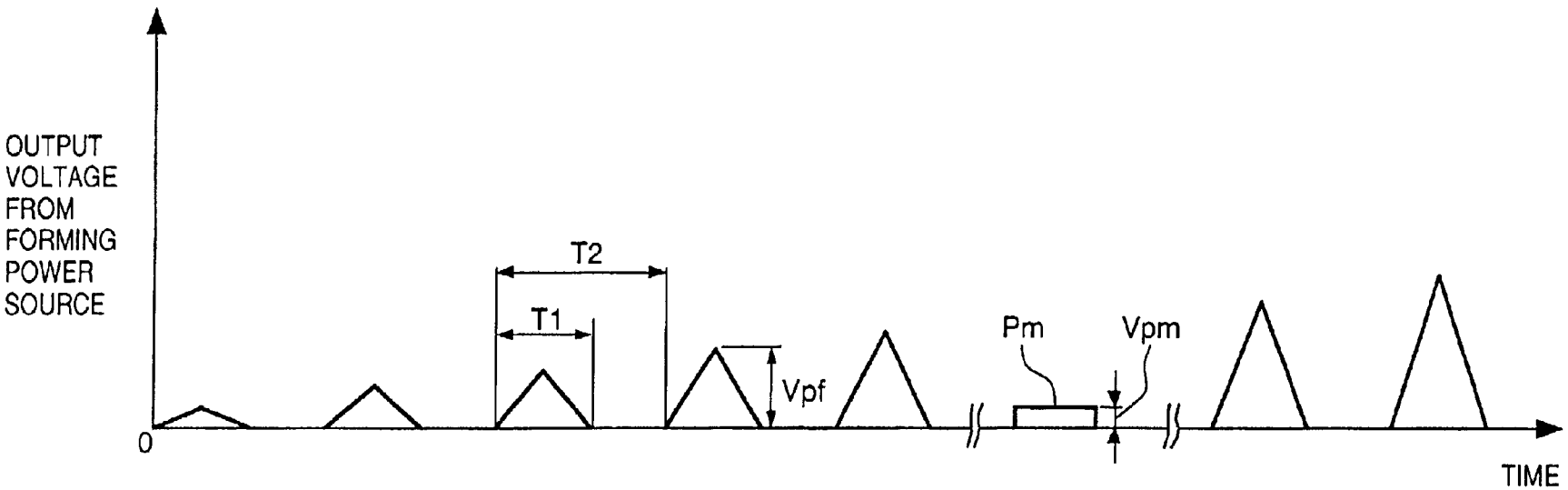
FIG. 16 is a graph showing an application voltage waveform in forming processing.

The electrification method will be explained in more detail with reference to FIG. 16 showing an example of waveform of appropriate voltage applied from the forming power source 1110. Preferably, in case of forming a conductive thin film of a fine particle film, a pulse-like voltage is employed. In this embodiment, as shown in FIG. 16, a triangular-wave pulse having a pulse width T1 is continuously applied at pulse interval of T2. Upon application, a wave peak value Vpf of the triangular-wave pulse is sequentially increased. Further, a monitor pulse Pm to monitor status of forming the first gap 1105 is inserted between the triangular-wave pulses at appropriate intervals, and current that flows at the insertion is measured by a galvanometer 1111.

In this embodiment, in $10^{-5}$ Torr vacuum atmosphere, the pulse width T1 is set to 1 msec; and the pulse interval T2, to 10 msec. The wave peak value Vpf is increased by 0.1 V, at each pulse. Each time the triangular-wave has been applied for five pulses, the monitor pulse Pm is inserted. To avoid ill-effecting the forming processing, a voltage Vpm of the monitor pulse is set to 0.1 V. When the electrical resistance between the device electrodes 1102 and 1103 becomes $1\times10^{6}\Omega$, i.e., the current measured by the galvanometer 1111 upon application of monitor pulse becomes $1\times10^{-7}$ Å or less, the electrification of the forming processing is terminated.

Note that the above processing method is preferable to the surface-conduction type emission device of the embodiment. In case of changing the design of the surface-conduction type emission device concerning, e.g., the material or thickness of the fine particle film, or the device electrode interval L, the conditions for electrification are preferably changed in accordance with the change of device design.

Figure 15D:
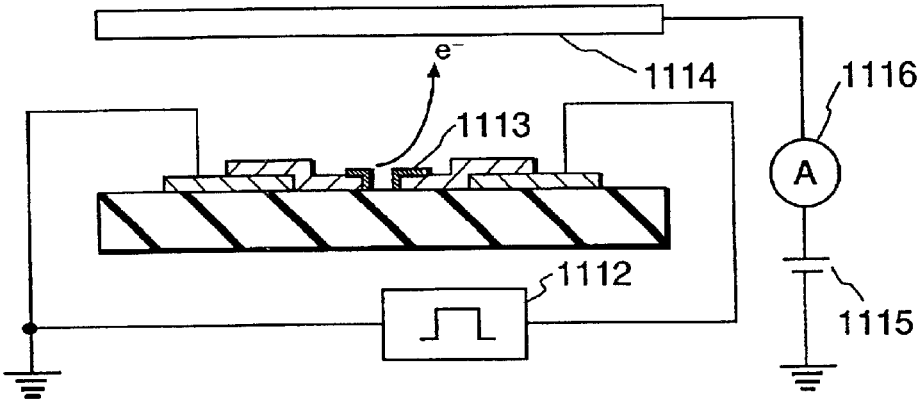

4) Next, as shown in FIG. 15D, appropriate voltage is applied, from an activation power source 1112, between the device electrodes 1102 and 1103, and the activation processing is performed to improve electron-emitting characteristic.

In this activation processing, electrification processing is done for the first gap formed by the forming processing, and carbon or a carbon compound is deposited on the conductive thin film 1104 and in the first gap 1105, as described above (in FIG. 15D, the deposited material of carbon or carbon compound is shown as material 1113.) Comparing the first gap 1105 with that before the activation processing, the emission current at the same application voltage has become, typically 100 times or greater.

The activation is made by periodically applying a voltage pulse in $10^{-4}$ or $10^{-5}$ Torr vacuum atmosphere, to accumulate carbon or carbon compound mainly derived from organic compound(s) existing in the vacuum atmosphere. The accumulated material 1113 is any of graphite monocrystalline, graphite polycrystalline, amorphous carbon or mixture thereof. The thickness of the accumulated material 1113 is 500 Å or less, more preferably, 300 Å or less.

Figure 17A:
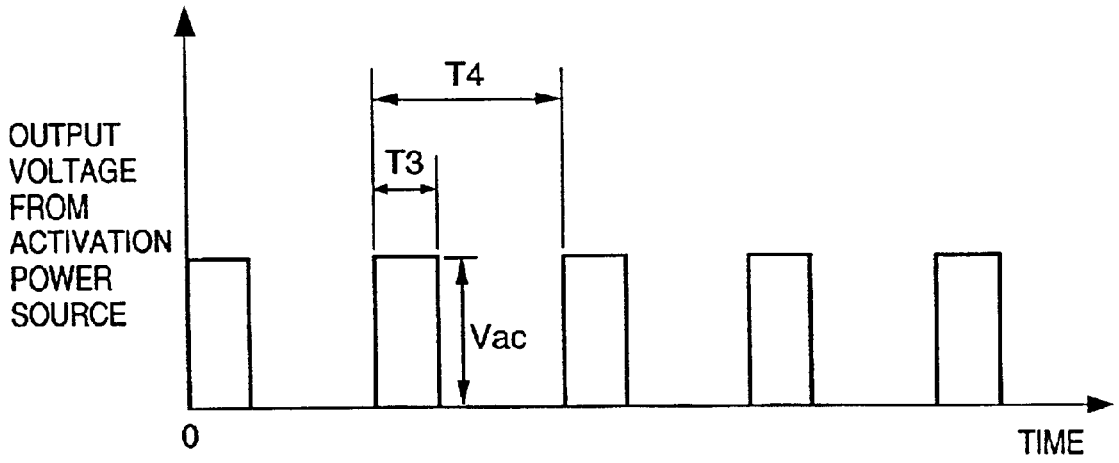
FIGS. 17A and 17B are graphs respectively showing an application voltage waveform and a change in emission current Ie in activation processing.

The electrification method will be described in more detail with reference to FIG. 17A showing an example of waveform of appropriate voltage applied from the activation power source 1112. In this embodiment, the activation processing is performed by periodically applying a rectangular wave at a predetermined voltage. A rectangular-wave voltage Vac is set to 14 V; a pulse width T3, to 1 msec; and a pulse interval T4, to 10 msec. Note that the above electrification conditions are preferable for the surface-conduction type emission device of the embodiment. In the case in which the design of the surface-conduction type emission device is changed, the electrification conditions are preferably changed in accordance with the change of device design.

Figure 17B:
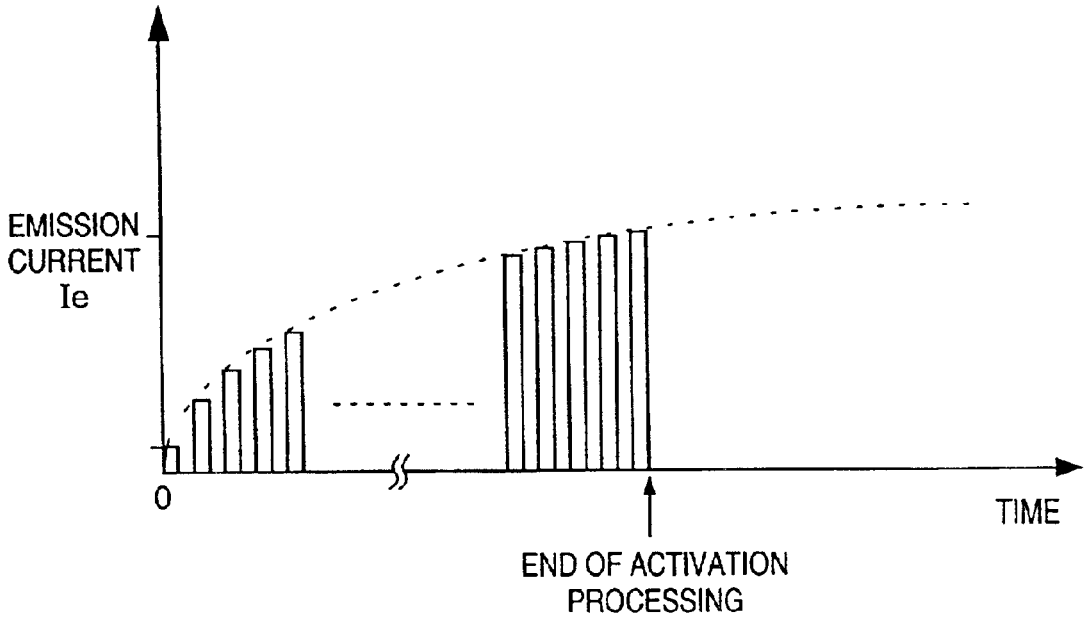

In FIG. 15D, reference numeral 1114 denotes an anode electrode, connected to a direct-current (DC) high-voltage power source 1115 and a galvanometer 1116, for capturing emission current Ie emitted from the surface-conduction type emission device. In the case in which the substrate 1101 is incorporated into the display panel before the activation processing, the fluorescent surface of the display panel is used as the anode electrode 1114. While applying voltage from the activation power source 1112, the galvanometer 1116 measures the emission current Ie and monitors the progress of activation processing to control the operation of the activation power source 1112. FIG. 17B shows an example of the emission current Ie measured by the galvanometer 1116. As application of pulse voltage from the activation power source 1112 is started in this manner, the emission current Ie increases with elapse of time, gradually comes into saturation, and almost never increases then. At the substantial saturation point, the voltage application from the activation power source 1112 is stopped, then the activation processing is terminated.

Note that the above electrification conditions are preferable to the surface-conduction type emission device of the embodiment. In case of changing the design of the surface-conduction type emission device, the conditions are preferably changed in accordance with the change of device design.

Figure 15E:
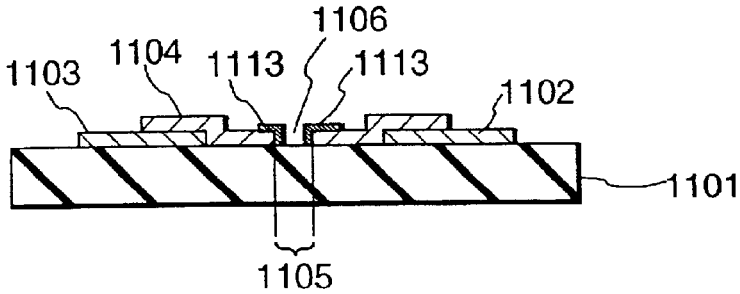

As described above, the surface-conduction type emission device as shown in FIG. 15E is manufactured.

(Step Surface-conduction Type Emission Device)

A step surface-conduction type emission device will be described.

Figure 18:
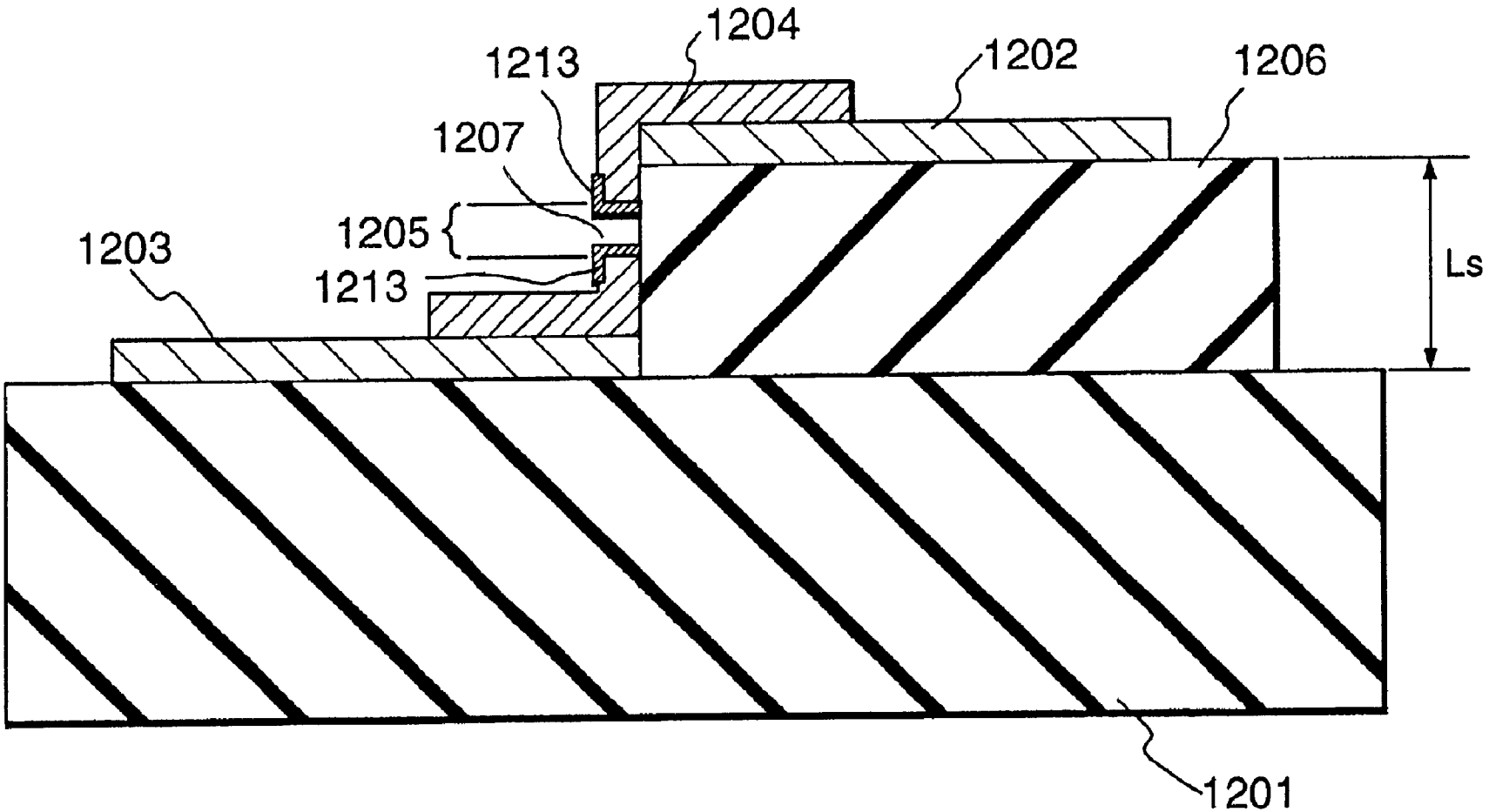
FIG. 18 is a sectional view showing a step type of surface-conduction type emission device used in the embodiment.

FIG. 18 is a sectional view schematically showing the basic construction of the step surface-conduction type emission device. Referring to FIG. 18, reference numeral 1201 denotes a substrate; 1202 and 1203, device electrodes; 1206, a step-forming member for making height difference between the electrodes 1202 and 1203; 1204, a conductive thin film using a fine particle film; 1205, a first gap formed by the forming processing; and 1213, a thin film formed by the activation processing.

Difference between the step device from the above-described flat device is that one of the device electrodes (1202 in this example) is provided on the step-forming member 1206 and the conductive thin film 1204 covers the side surface of the step-forming member 1206. The device interval L in FIGS. 14A and 14B is set in this structure as a height difference Ls corresponding to the height of the step-forming member 1206. Note that the substrate 1201, the device electrodes 1202 and 1203, and the conductive thin film 1204 using the fine particle film can comprise the materials given in the explanation of the flat surface-conduction type emission device. Further, the step-forming member 1206 comprises electrically insulating material such as $SiO_2$.

Next, a method of manufacturing the step surface-conduction type emission device will be described.

FIGS. 19A to 19F which are sectional views showing the manufacturing processes. In these figures, reference numerals of the respective parts are the same as those in FIG. 18.

Figure 19A:
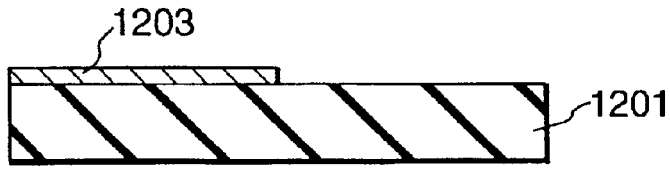
FIGS. 19A to 19F are sectional views showing the steps in manufacturing the step type of surface-conduction type emission device.

1) First, as shown in FIG. 19A, the device electrode 1203 is formed on the substrate 1201.

Figure 19B:
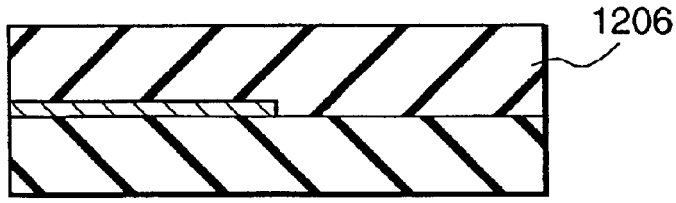

2) Next, as shown in FIG. 19B, an insulating layer for forming the step-forming member is deposited. The insulating layer may be formed by accumulating, e.g., $SiO_2$ by a sputtering method, however, the insulating layer may be formed by a film-forming method such as a vacuum evaporation method or a printing method.

Figure 19C:
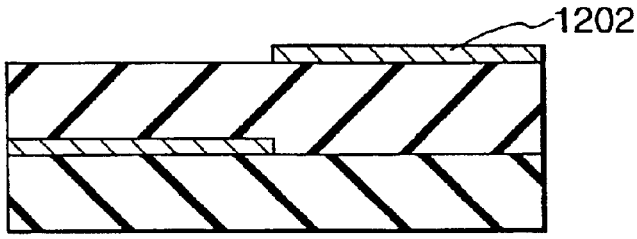

3) Next, as shown in FIG. 19C, the device electrode 1202 is formed on the insulating layer.

Figure 19D:
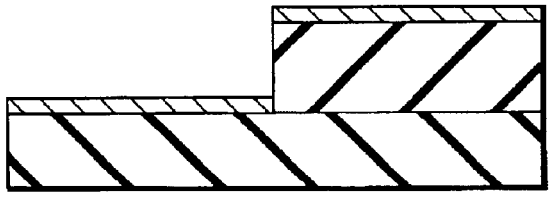

4) Next, as shown in FIG. 19D, a part of the insulating layer is removed by using, e.g., an etching method, to expose the device electrode 1203.

Figure 19E:
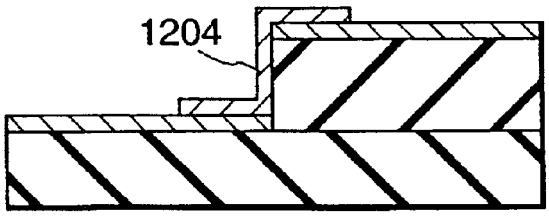

5) Next, as shown in FIG. 19E, the conductive thin film 1204 using the fine particle film is formed. Upon formation, similar to the above-described flat device structure, a film-forming technique such as an applying method is used.

6) Next, similar to the flat device structure, the forming processing is performed to form the first gap 1205. (The forming processing similar to that explained using FIG. 15C may be performed.)

7) Next, similar to the flat device structure, the activation processing is performed to deposit carbon or carbon compound on the conductive thin film 1204 and in the first gap 1205. (Activation processing similar to that explained using FIG. 15D may be performed). Also in this case, the film 1213 mainly made of the deposited carbon or carbon compound is deposited in the first gap 1205 so as to form a second gap 1207 narrower than the first gap.

Figure 19F:
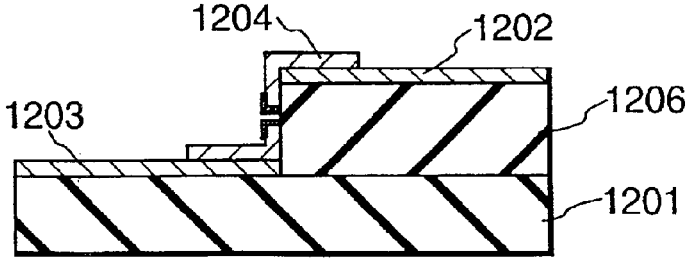

In this way, the step surface-conduction type emission device shown in FIG. 19F is manufactured.

(Characteristic of Surface-conduction Type Emission Device Used in Display Apparatus)

The structure and manufacturing method of the flat surface-conduction type emission device and those of the step surface-conduction type emission device are as described above. Next, the characteristic of the device used in the display apparatus will be described below.

Figure 20:
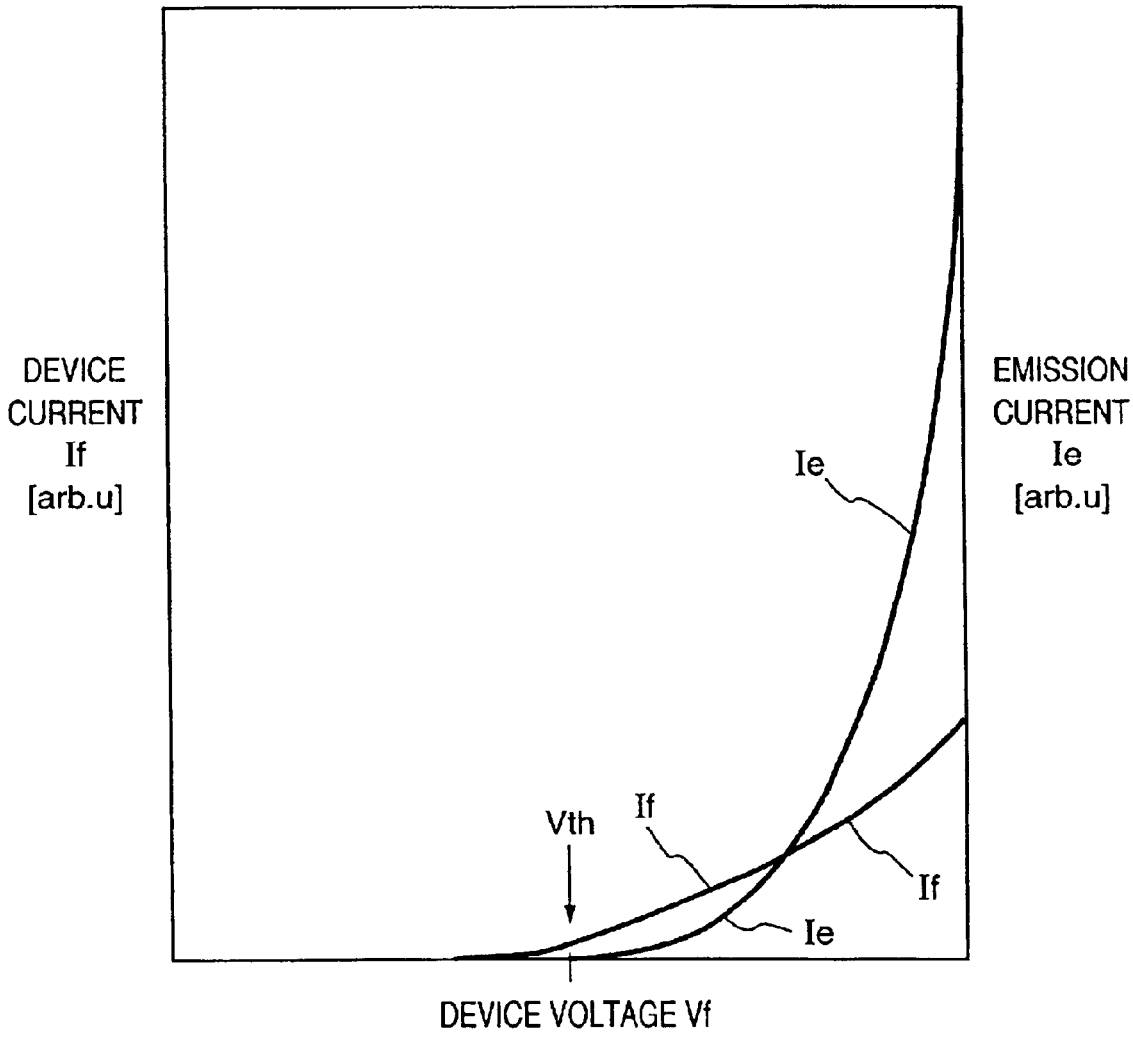
FIG. 20 is a graph showing the typical characteristics of the surface-conduction type emission device used in the embodiment.

FIG. 20 shows a typical example of (emission current Ie) to (device application voltage Vf) characteristic and (device current If) to (device application voltage Vf) characteristic of the device used in the display apparatus. Note that compared with the device current If, the emission current Ie is very small, therefore it is difficult to illustrate the emission current Ie by the same measure of that for the device current If. In addition, these characteristics change due to change of designing parameters such as the size or shape of the device. For these reasons, two lines in the graph of FIG. 20 are respectively given in arbitrary units. Regarding the emission current Ie, the device used in the display apparatus has three characteristics as follows:

First, when voltage of a predetermined level (referred to as "threshold voltage Vth") or greater is applied to the device, the emission current Ie drastically increases, however, with voltage lower than the threshold voltage Vth, almost no emission current Ie is detected. That is, regarding the emission current Ie, the device has a nonlinear characteristic based on the clear threshold voltage Vth.

Second, the emission current Ie changes in dependence upon the device application voltage Vf. Accordingly, the emission current Ie can be controlled by changing the voltage Vf.

Third, the emission current Ie is output quickly in response to application of the device voltage Vf to the device. Accordingly, an electrical charge amount of electrons to be emitted from the device can be controlled by changing period of application of the device voltage Vf.

The surface-conduction type emission device with the above three characteristics is preferably applied to the display apparatus. For example, in a display apparatus having a large number of devices provided corresponding to the number of pixels of a display screen, if the first characteristic is utilized, display by sequential scanning of display screen is possible. This means that the threshold voltage Vth or greater is appropriately applied to a driven device in accordance with a desired emission luminance, while voltage lower than the threshold voltage Vth is applied to an unselected device. In this manner, sequentially changing the driven devices enables display by sequential scanning of display screen.

Further, emission luminance can be controlled by utilizing the second or third characteristic, which enables multi-gradation display.

(Structure of Multi Electron Source with Many Devices Arranged in Simple Matrix)

Next, the structure of the multi electron source having the above-described surface-conduction type emission devices arranged on the substrate with the simple-matrix wiring will be described below.

Figure 21:
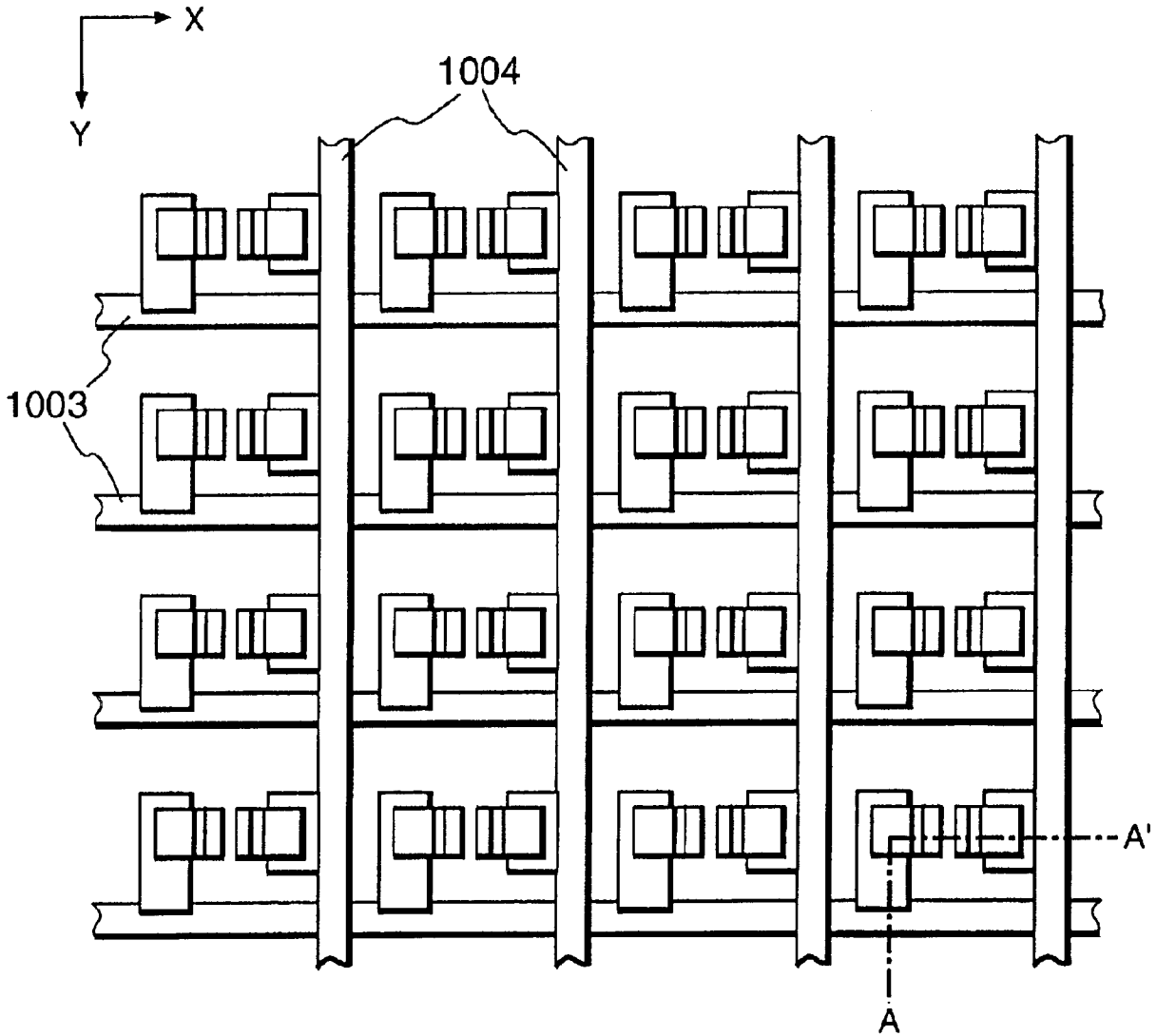
FIG. 21 is a plan view showing the substrate of a multi electron source used in the embodiment.

FIG. 21 is a plan view of the multi electron source used in the display panel in FIG. 12. There are surface-conduction type emission devices like the one shown in FIGS. 14A and 14B on a substrate. These devices are arranged in a simple matrix with the row and column wirings 1003 and 1004. At an intersection of the row and column wirings 1003 and 1004, an insulating layer (not shown) is formed between the electrons to maintain electrical insulation.

Figure 22:
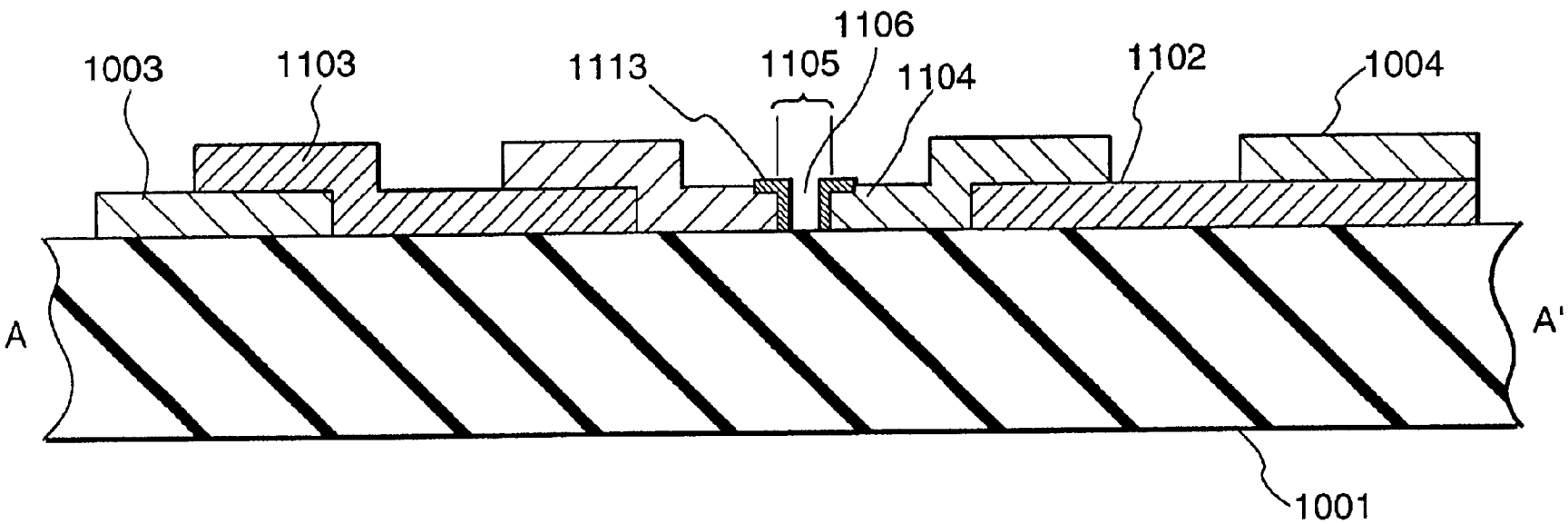
FIG. 22 is a sectional view showing a substrate of the multi electron source taken along the line A–A' in FIG. 21.
Figure 24:
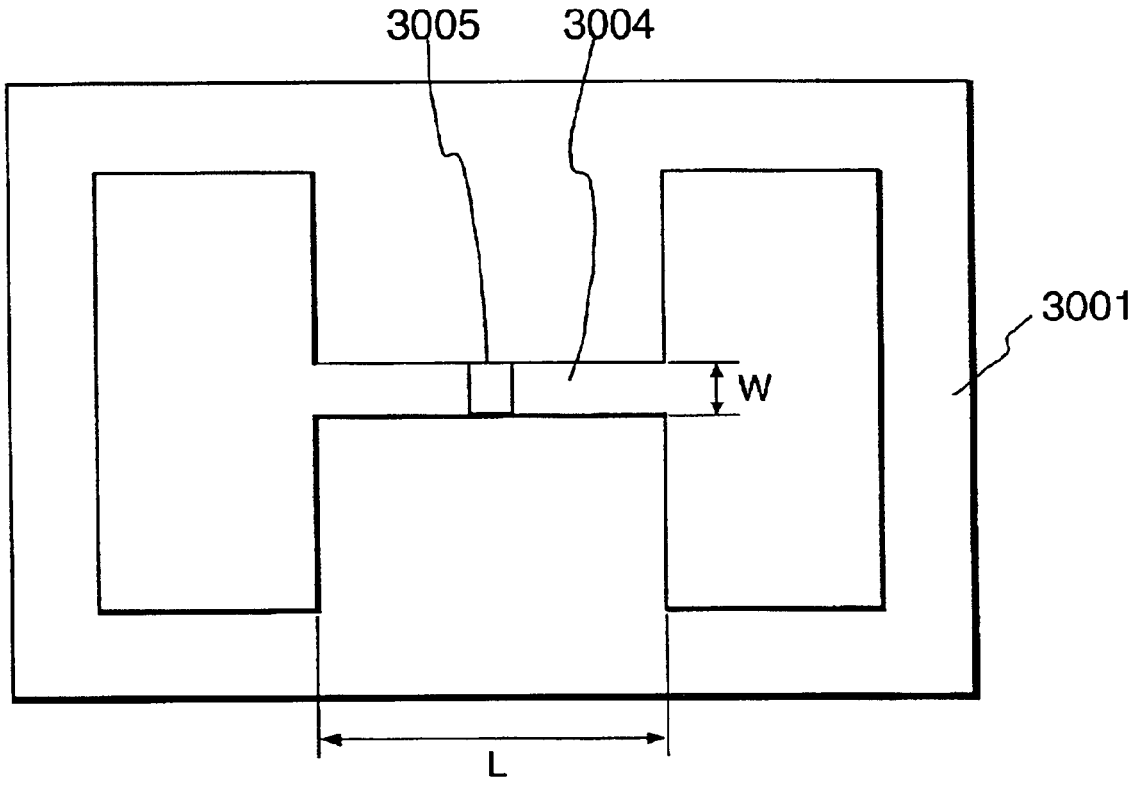
FIG. 24 is a plan view showing an example of a conventionally known surface-conduction type emission device.
Figure 25:
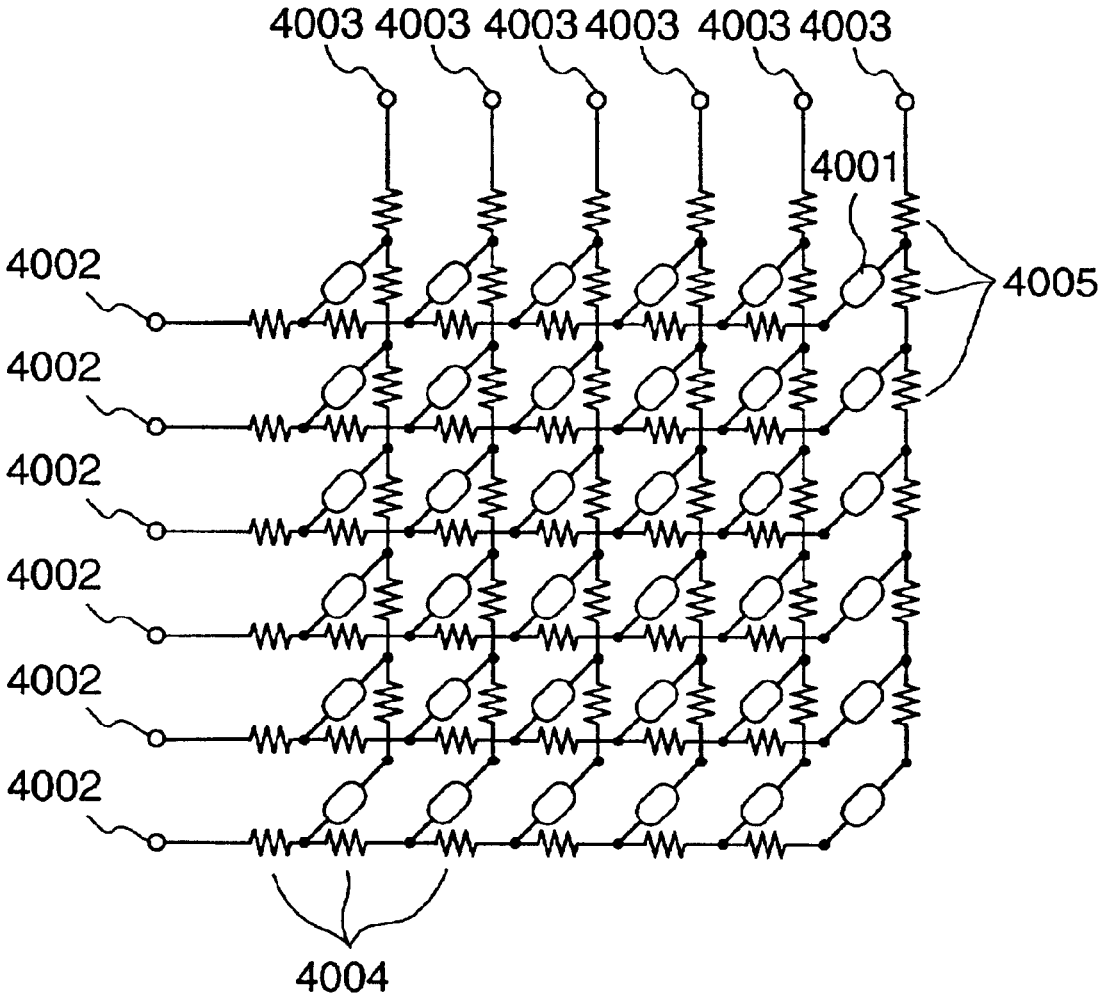
FIG. 25 is a circuit diagram for explaining matrix wiring suffering problems to be solved by the present invention.
Figure 26:
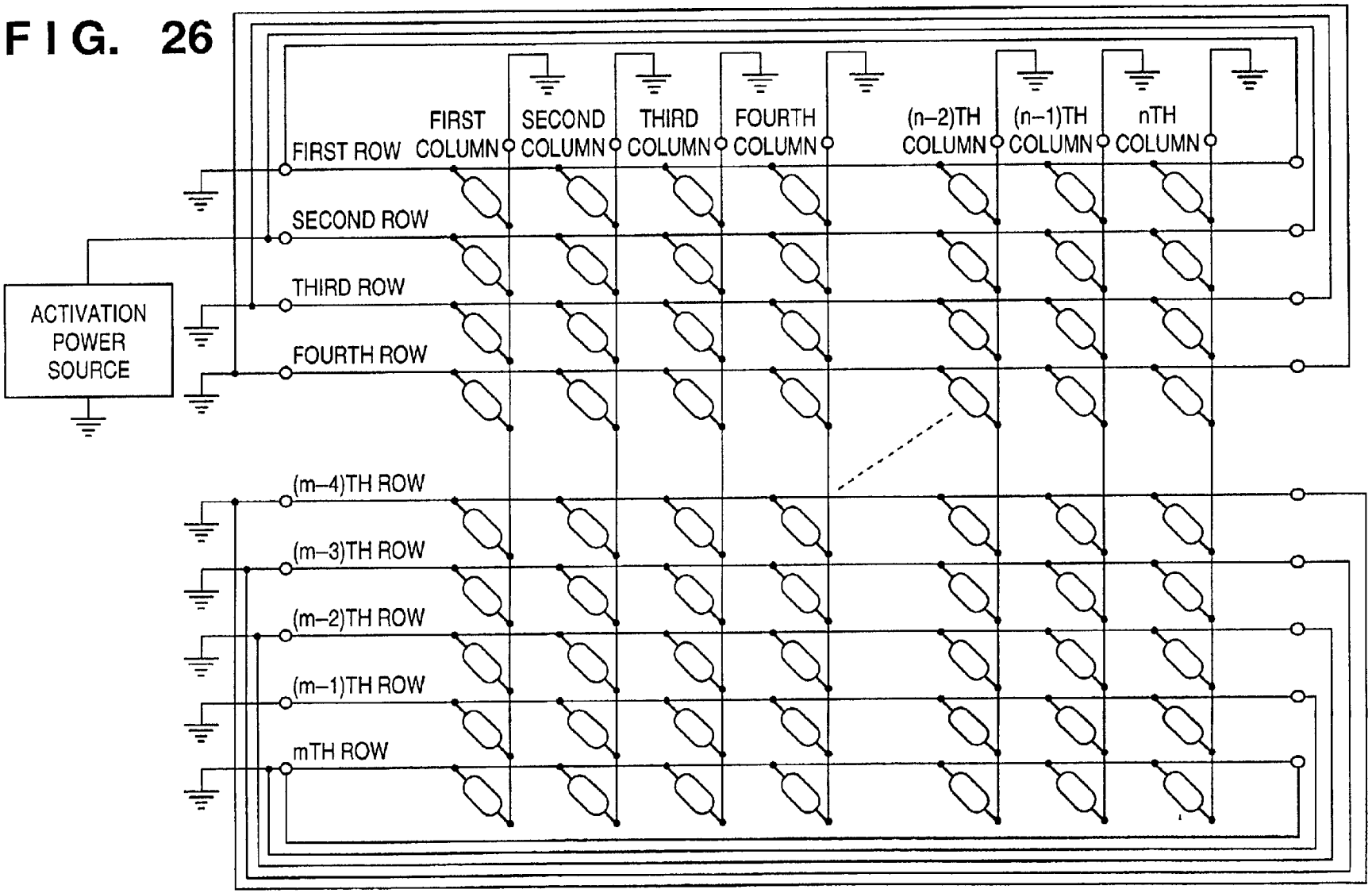
FIG. 26 is an equivalent circuit diagram when the second row wiring is to be activated.

FIG. 22 shows a cross-section cut out along the line A–A' in FIG. 21.

Note that a multi electron source having such a structure is manufactured by forming the row and column wirings 1003 and 1004, the inter-electrode insulating layers (not shown), and the device electrodes and conductive thin films of the surface-conduction type emission devices on the substrate, then supplying electricity to the respective devices via the row and column wirings 1003 and 1004, thus performing the forming processing and the activation processing.

FIG. 23 is a block diagram showing an example of a display apparatus capable of displaying image information provided from various image information sources such as television broadcasting on a display panel using the surface-conduction type emission device of this embodiment as an electron source. Referring to FIG. 23, reference numeral 1000 denotes a display panel; 2101, a driving circuit for the display panel; 2102, a display controller; 2103, a multiplexer; 2104, a decoder; 2105, an I/O interface circuit; 2106, a CPU; 2107, an image generation circuit; 2108, 2109, and 2110, image memory interface circuits; 2111, an image input interface circuit; 2112 and 2113, TV signal reception circuits; and 2114, an input portion. When this display apparatus receives a signal containing both video information and audio information such as a TV signal, the apparatus displays the video information while reproducing the audio information. A description of a circuit or a speaker for reception, division, reproduction, processing, storage, or the like of the audio information, which is not directly related to the features of the present invention, will be omitted.

The functions of the respective parts will be explained in accordance with the flow of an image signal.

The TV signal reception circuit 2113 receives a TV image signal transmitted using a radio transmission system such as radio waves or spatial optical communication. The scheme of the TV signal to be received is not particularly limited, and is the NTSC scheme, the PAL scheme, the SECAM scheme, or the like. A more preferable signal source to take the advantages of the display panel realizing a large area and a large number of pixels is a TV signal (e.g., a so-called high-quality TV of the MUSE scheme or the like) made up of a larger number of scanning lines than that of the TV signal of the above scheme. The TV signal received by the TV signal reception circuit 2113 is output to the decoder 2104. The TV signal reception circuit 2112 receives a TV image signal transmitted using a wire transmission system such as a coaxial cable or optical fiber. The scheme of the TV signal to be received is not particularly limited, as in the TV signal reception circuit 2113. The TV signal received by the circuit 2112 is also output to the decoder 2104.

The image input interface circuit 2111 receives an image signal supplied from an image input device such as a TV camera or image read scanner, and outputs it to the decoder 2104. The image memory interface circuit 2110 receives an image signal stored in a video tape recorder (to be briefly referred to as a VTR hereinafter), and outputs it to the decoder 21004. The image memory interface circuit 2109 receives an image signal stored in a video disk, and outputs it to the decoder 2104. The image memory interface circuit 2108 receives an image signal from a device storing still image data such as a so-called still image disk, and outputs the received still image data to the decoder 2104.

The I/O interface circuit 2105 connects the display apparatus to an external computer, computer network, or output device such as a printer. The I/O interface circuit 2105 allows inputting/outputting image data, character data, and graphic information, and in some cases inputting/outputting a control signal and numerical data between the CPU 2106 of the display apparatus and an external device.

The image generation circuit 2107 generates display image data on the basis of image data or character/graphic information externally input via the I/O interface circuit 2105, or image data or character/graphic information output from the CPU 2106. This circuit 2107 incorporates circuits necessary to generate images such as a programmable memory for storing image data and character/graphic information, a read-only memory storing image patterns corresponding to character codes, and a processor for performing image processing. Display image data generated by the circuit 2107 is output to the decoder 2104. In some cases, display image data can also be input/output from/to an external computer network or printer via the I/O interface circuit 2105.

The CPU 2106 mainly .performs control of operation of the display apparatus according to this embodiment, and operations concerning generation, selection, and editing of display images. For example, the CPU 2106 outputs a control signal to the multiplexer 2103 to properly select or combine image signals to be displayed on the display panel. At this time, the CPU 2106 generates a control signal to the display panel controller 2102 in accordance with the image signals to be displayed, and appropriately controls operation of the display apparatus in terms of the screen display frequency, the scanning method (e.g., interlaced or non-interlaced scanning), the number of scanning lines for one frame, and the like.

The CPU 2106 directly outputs image data or character/graphic information to the image generation circuit 2107. In addition, the CPU 2106 accesses an external computer or memory via the I/O interface circuit 2105 to input image data or character/graphic information.

The CPU 2106 may also be concerned with operations for other purposes. For example, the CPU 2106 can be directly concerned with the function of generating and processing information, like a personal computer or wordprocessor. Alternatively, the CPU 2106 may be connected to an external computer network via the I/O interface circuit 2105 to perform operations such as numerical calculation in cooperation with the external device.

The input portion 2114 allows the user to input an instruction, program, or data to the CPU 2106. As the input portion 2114, various input devices such as a joystick, bar code reader, and speech recognition device are available in addition to a keyboard and mouse. The decoder 2104 inversely converts various image signals input from the circuits 2107 to 2113 into three primary color signals, or a luminance signal and I and Q signals. As is indicated by the dotted line in FIG. 23, the decoder 2104 desirably incorporates an image memory in order to process a TV signal of the MUSE scheme or the like which requires an image memory in inverse conversion. This image memory advantageously facilitates display of a still image, or image processing and editing such as thinning, interpolation, enlargement, reduction, and synthesis of images in cooperation with the image generation circuit 2107 and CPU 2106.

The multiplexer 2103 appropriately selects a display image on the basis of a control signal input from the CPU 2106. More specifically, the multiplexer 2103 selects a desired one of the inversely converted image signals input from the decoder 2104, and outputs the selected image signal to the driving circuit 2101. In this case, the image signals can be selectively switched within a 1-frame display time to display different images in a plurality of areas of one frame, like a so-called multiwindow television.

The display panel controller 2102 controls operation of the driving circuit 2101 on the basis of a control signal input from the CPU 2106. As for the basic operation of the display panel, the display panel controller 2102 outputs, e.g., a signal for controlling the operation sequence of a driving power source (not shown) of the display panel to the driving circuit 2101. As for the method of driving the display panel, the display panel controller 2102 outputs, e.g., a signal for controlling the screen display frequency or scanning method (e.g., interlaced or non-interlaced scanning) to the driving circuit 2101. In some cases, the display panel controller 2102 outputs to the driving circuit 2101 a control signal concerning adjustment of the image quality such as the brightness, contrast, color tone, or sharpness of a display image. The driving circuit 2101 generates a driving signal to be applied to the display panel 1000, and operates based on an image signal input from the multiplexer 2103 and a control signal input from the display panel controller 2102.

The functions of the respective parts have been described. The arrangement of the display apparatus shown in FIG. 23 makes it possible to display image information input from various image information sources on the display panel 1000. More specifically, various image signals such as television broadcasting image signals are inversely converted by the decoder 2104, appropriately selected by the multiplexer 2103, and supplied to the driving circuit 2101. On the other hand, the display controller 2102 generates a control signal for controlling operation of the driving circuit 2101 in accordance with an image signal to be displayed. The driving circuit 2101 applies a driving signal to the display panel 1000 on the basis of the image signal and control signal. As a result, the image is displayed on the display panel 1000. A series of operations are systematically controlled by the CPU 2106.

In this display apparatus, the image memory incorporated in the decoder 2104, the image generation circuit 2107, and the CPU 2106 can cooperate with each other to simply display selected ones of a plurality of pieces of image information and to perform, for the image information to be displayed, image processing such as enlargement, reduction, rotation, movement, edge emphasis, thinning, interpolation, color conversion, and conversion of the aspect ratio of an image, and image editing such as synthesis, erasure, connection, exchange, and pasting. Although not described in this embodiment, an audio circuit for processing and editing audio information may be arranged, similar to the image processing and the image editing.

The display apparatus can therefore function as a display device for television broadcasting, a terminal device for video conferences, an image editing device for processing still and dynamic images, a terminal device for a computer, an office terminal device such as a wordprocessor, a game device, and the like. This display apparatus is useful for industrial and business purposes and can be variously applied.

FIG. 23 merely shows an example of the arrangement of the display apparatus using the display panel using the surface-conduction type emission device as an electron source. The present invention is not limited to this, as a matter of course. For example, among the constituents in FIG. 23, a circuit associated with a function unnecessary for the application purpose can be eliminated from the display apparatus. To the contrary, another constituent can be added to the display apparatus in accordance with the application purpose. For example, when the display apparatus is used as a television telephone set, transmission and reception circuits including a television camera, audio microphone, lighting, and modem are preferably added as constituents.

Since particularly the display panel using the surface-conduction type emission device as an electron source can be easily made thin in the display apparatus, the whole display apparatus can be made thin. In addition to this, the display panel using the surface-conduction type emission device as an electron source is easily increased in screen size and has high brightness and wide view angle. This display apparatus can therefore display an impressive image with reality and high visibility.

Note that negative and positive potentials are respectively applied to row and column wirings in the above embodiments. However, the present invention is not limited to this, and positive and negative potentials may be respectively applied to row and column wirings.

In contrast to the above embodiments, it is also possible that column wirings are sequentially selected, and a compensation voltage is applied to row wirings to detect a row wiring flowing a leakage current. In short, the method of applying a voltage to row and column wirings is not limited to the above-described embodiments.

In the embodiments, devices are sequentially activated in units of lines. However, the present invention is not limited to this, and devices may be activated in units of columns.

In the above embodiments, the influence of a voltage drop by the wiring resistance is not corrected in applying a resistance increase pulse. However, the present invention is not limited to this, and this influence may be compensated for. In this case, a voltage value for compensating for the voltage drop is estimated from a current value monitored in activation processing.

The above embodiments can provide an electron source having a plurality of surface-conduction type emission devices whose device characteristics are made uniform on the entire substrate by detecting a reactive current which does not contribute to activation in activation processing, and activating the devices while applying a resistance increase pulse to a device flowing the reactive current.

By forming a display panel using the electron source having a plurality of surface-conduction type emission devices, an image display apparatus which is almost free from any luminance distribution and can form a bright, high-quality image can be realized.

According to the above embodiments, a reactive current flowing through an unselected device can be reduced in activation processing.

The above embodiments can provide an electron source whose electron-emitting characteristics are made uniform by applying the same voltage to all devices to activate them, and an image display apparatus using the electron source.

According to the above embodiments, deterioration of surface-conduction type emission devices can be prevented.

As has been described above, the present invention can reduce a reactive current in the electrification step in manufacturing an electron source having a plurality of electron-emitting devices.

The present invention can reduce the power source capacity of a manufacturing apparatus used in the electrification step in manufacturing an electron source having a plurality of electron-emitting devices.

The present invention can provide an electron source having a plurality of electron-emitting devices whose electron-emitting characteristics are uniform with each other, and a manufacturing method therefor.

The present invention can provide an image display apparatus almost free from any luminance variations, and a manufacturing method therefor.

Furthermore, the present invention can prevent deterioration of electron-emitting devices in the manufacture or driving.

As many apparently widely different embodiments of the present invention can be made without departing from the spirit and scope thereof, it is to be understood that the invention is not limited to the specific embodiments thereof except as defined in the appended claims.

What is claimed is:

1. A method of manufacturing an electron source, comprising:

a step of forming, on a substrate, a plurality of row wirings, a plurality of column wirings, and a plurality of pairs of conductive films arranged in a matrix by the pluralities of row and column wirings, each pair of conductive films being formed through a gap;

a first voltage application step of selecting a row wiring among the plurality of row wirings in the presence of an activation substance source, and applying a substantially same constant voltage to each of a plurality of pairs of conductive films connected to the selected row wiring; and a second voltage application step of applying a voltage having a voltage drop rate of 10 V/sec or more to at least specific pairs of conductive films among a plurality of pairs of conductive films.

2. The method according to claim 1, further comprising a step of detecting currents flowing through the column wirings.

3. The method according to claim 2, wherein the step of detecting currents comprises a step of detecting currents flowing through the column wirings in said first voltage application step.

4. The method according to claim 1, further comprising a step of detecting currents flowing through the row wirings and the column wirings.

5. The method according to claim 4, wherein the step of detecting currents comprises a step of detecting currents flowing through the row wirings and the column wirings in said first voltage application step.

6. The method according to claim 1, wherein the activation substance source contains a substance which is deposited on the conductive film to increase an emission current.

7. The method according to claim 1, wherein the activation substance source is a carbon compound.

8. The method according to claim 1, wherein said first voltage application step comprises sequentially selecting each of the plurality of row wirings and applying the voltage.

9. The method according to claim 1, wherein said second voltage application step comprises applying a voltage to all the plurality of pairs of conducted films connected to unselected row wirings.

10. A method of manufacturing an image display apparatus having an electron source having, on a substrate, a plurality of row wirings, a plurality of column wirings, and a plurality of electron-emitting devices arranged in a matrix by the pluralities of row and column wirings, and a fluorescent film irradiated with electrons from the electron source, wherein the electron source is manufactured by a method comprising:

a step of forming, on the substrate, the plurality of row wirings, the plurality of column wirings, and a plurality of pairs of conductive films arranged in a matrix by the pluralities of row and column wirings, each pair of conductive films being formed through a gap;

a first voltage application step of selecting a row wiring among the plurality of row wirings in the presence of an activation substance source, and applying a substantially same constant voltage to each of a plurality of pairs of conductive films connected to the selected row wiring; and a second voltage application step of applying a voltage having a voltage drop rate of 10 V/sec or more to at least specific pairs of conductive films among a plurality of pairs of conductive films.

11. A method of manufacturing an electron source, comprising:

a step of forming, on a substrate, a plurality of row wirings, a plurality of column wirings, and a plurality of pairs of conductive films arranged in a matrix by the pluralities of row and column wirings, each pair of conductive films being formed through a gap;

a first voltage application step of selecting a row wiring among the plurality of row wirings in the presence of an activation substance source, and applying, to the plurality of column wirings, a voltage set to compensate for influence of a voltage drop caused by the selected row wiring; and a second voltage application step of applying a voltage having a voltage drop rate of 10 V/sec or more to at least specific pairs of conductive films among a plurality of pairs of conductive films.

12. A method of manufacturing an electron source, comprising:

a step of forming, on a substrate, a plurality of row wirings, a plurality of column wirings, and a plurality of conductive films each having an electron-emitting portion that are arranged in a matrix by the pluralities of row and column wirings;

a first voltage application step of selecting a row wiring among the plurality of row wirings in the presence of an activation substance source, and applying a substantially same constant voltage to each of a plurality of conductive films connected to the selected row wiring; and a second voltage application step of applying a voltage having a voltage drop rate of 10 V/sec or more to specific conductive films among the plurality of conductive films.

13. A method of manufacturing an electron source, comprising:

a step of forming, on a substrate, a plurality of row wirings, a plurality of column wirings, and a plurality of conductive films each having an electron-emitting portion that are arranged in a matrix by the pluralities of row and column wirings;

a first voltage application step of selecting a row wiring among the plurality of row wirings in the presence of an activation substance source, and applying, to the plurality of column wirings, a voltage set to compensate for influence of a voltage drop caused by the selected row wiring; and a second voltage application step of applying a voltage having a voltage drop rate of 10 V/sec or more to specific conductive films among the plurality of conductive films.

* * * * *

UNITED STATES PATENT AND TRADEMARK OFFICE

CERTIFICATE OF CORRECTION

PATENT NO. : 6,929,522 B1
DATED : August 16, 2005
INVENTOR(S) : Tsuyoshi Takegami It is certified that error appears in the above-identified patent and that said Letters Patent is hereby corrected as shown below:

Column 6,
Line 45, “the-present” should read -- the present --.

Column 12,
Line 44, “k-2)+*Rk*-1x(*If*-Σ*if(j)*+*Rk*=(*If*-Σ*if(j)))*” should read -- k-2)+*Rk*-1x(*If*-Σ*if(j)*+*Rk*x= (*If*-Σ*if(j)))* --.

Column 13,
Line 9, “terminal. Dxl.” should read -- terminal Dxl. --;
Line 11, “period. T2” should read -- period T2 --;
Line 36, “n” should read -- in --;
Line 56, “immediately:” should read -- immediately --; and
Line 63, “current is” should read -- current Is --.

Column 14,
Line 60, “*If*_leak_*i*=(Σ*If*_gaso_*j*)-*If*_line_*i*(=1 to *n*)” should read -- *If*_leak_*i*= (Σ*If*_gaso_*j*)-*If*_line_*i*(*j*=1 to *n*) --.

Column 15,
Line 53, “I_leak_i≦1_ I_” should read -- I_leak_i≦I_ --.

Column 19,
Line 11, “If_gaso_j(j-1, 2, . . . , n)” should read -- If_gaso_j(j=1, 2, ... , n) --; and
Line 22, “Jth column” should read -- jth column --.

Column 29,
Line 45, “decoder 21004.” should read -- decoder 2104. --.

UNITED STATES PATENT AND TRADEMARK OFFICE

CERTIFICATE OF CORRECTION

PATENT NO. : 6,929,522 B1
DATED : August 16, 2005
INVENTOR(S) : Tsuyoshi Takegami It is certified that error appears in the above-identified patent and that said Letters Patent is hereby corrected as shown below:

Column 30,
Line 5, ".performs" should read -- performs --.

Signed and Sealed this

Twenty-eighth Day of March, 2006

JON W. DUDAS
*Director of the United States Patent and Trademark Office*